US010493512B2

(12) United States Patent
Suzuki et al.

(10) Patent No.: US 10,493,512 B2
(45) Date of Patent: Dec. 3, 2019

(54) PRESS-MOLDED ARTICLE MANUFACTURING METHOD AND PRESS APPARATUS

(71) Applicant: NIPPON STEEL & SUMITOMO METAL CORPORATION, Tokyo (JP)

(72) Inventors: Toshiya Suzuki, Tokyo (JP); Yoshiaki Nakazawa, Tokyo (JP); Masahiro Nakata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/071,017

(22) PCT Filed: Jan. 19, 2017

(86) PCT No.: PCT/JP2017/001785

§ 371 (c)(1),
(2) Date: Jul. 18, 2018

(87) PCT Pub. No.: WO2017/126619

PCT Pub. Date: Jul. 27, 2017

(65) Prior Publication Data

US 2019/0022729 A1 Jan. 24, 2019

(30) Foreign Application Priority Data

Jan. 21, 2016 (JP) ..... 2016-009530

(51) Int. Cl.
*B21D 22/21* (2006.01)
*B21D 22/26* (2006.01)
(Continued)

(52) U.S. Cl.
CPC ..... *B21D 22/21* (2013.01); *B21D 22/26* (2013.01); *B21D 24/00* (2013.01); *B21D 24/04* (2013.01); *B21D 53/88* (2013.01)

(58) Field of Classification Search
CPC ..... B21D 22/21; B21D 22/22; B21D 22/26; B21D 24/04; B21D 24/10; B21D 53/88
See application file for complete search history.

(56) References Cited

U.S. PATENT DOCUMENTS

2012/0279273 A1 11/2012 Tsuchiya et al.
2014/0182349 A1* 7/2014 Yonemura ..... B21D 22/26 72/349
(Continued)

FOREIGN PATENT DOCUMENTS

EP 1792671 A1 6/2007
JP 2012-51005 A 3/2012
(Continued)

OTHER PUBLICATIONS

International Preliminary Report on Patentability and English translation of Written Opinion of the International Searching Authority for PCT/JP2017/001785, dated Jul. 24, 2018 (Forms PCT/IB/373 and PCT/ISA/237).
(Continued)

*Primary Examiner* — Debra M Sullivan
(74) *Attorney, Agent, or Firm* — Birch, Stewart, Kolasch & Birch, LLP

(57) ABSTRACT

A method of manufacturing a press-molded article includes: projecting an inner pad, provided at an apex portion of a punch, from the punch toward a side of a die, and disposing a metal sheet blank on the inner pad; and projecting a die pad, provided at the die, from the die toward a side of the punch to dispose the die pad at a position separated from the inner pad by a predetermined distance that is greater than a plate thickness of the metal sheet blank; forming a side walls by moving the die toward the punch side relative to the die pad, the inner pad, and the punch, and integrating the die pad with the die; and forming a top plate by moving the die and the die pad, which have been integrated, and the inner pad, toward the punch side relative to the punch.

13 Claims, 22 Drawing Sheets

(51) Int. Cl.

| | |
|---|---|
| ***B21D 24/00*** | (2006.01) |
| ***B21D 24/04*** | (2006.01) |
| ***B21D 53/88*** | (2006.01) |

(56) References Cited

U.S. PATENT DOCUMENTS

| | | | |
|---|---|---|---|
| 2014/0356643 | A1 | 12/2014 | Nakata et al. |
| 2016/0121384 | A1 | 5/2016 | Sumikawa et al. |

FOREIGN PATENT DOCUMENTS

| | | | |
|---|---|---|---|
| JP | 2012-232329 | A | 11/2012 |
| JP | 5079655 | B2 | 11/2012 |
| JP | 2013-27894 | A | 2/2013 |
| JP | 2015-27698 | A | 2/2015 |
| WO | WO 2013/094705 | A1 | 6/2013 |

OTHER PUBLICATIONS

International Search Report for PCT/JP2017/001785 (PCT/ISA/210) dated Apr. 11, 2017.
Written Opinion of the International Searching Authority for PCT/JP2017/001785 (PCT/ISA/237) dated Apr. 11, 2017.
Extended European Search Report dated Jan. 23, 2019, for corresponding European Patent Application No. 17741496.8.
English translation of Written Opinion of the International Searching Authority dated Apr. 11, 2017.

* cited by examiner

PRESS-MOLDED ARTICLE MANUFACTURING METHOD AND PRESS APPARATUS

TECHNICAL FIELD

The present disclosure relates to a manufacturing method for a press-molded article, and to a press apparatus.

BACKGROUND ART

Japanese Patent No. 5079655 (Patent Document 1) and Japanese Patent Application Laid-Open (JP-A) No. 2012-51005 (Patent Document 2), for example, disclose methods for manufacturing press-molded articles with a U-shaped cross-section profile (gutter profile).

In these press-molded article manufacturing methods, a metal sheet blank is held by a punch-side pad (also referred to hereafter as an inner pad) projecting from a punch and by a die-side pad (also referred to hereafter as a die pad) projecting from a die bottom of a die. The die is pushed in toward the punch side in this state, so as to mold the press-molded article. The occurrence of spring-back is thereby suppressed in the press-molded article.

In these press-molded article manufacturing methods, the punch-side pad projects from the punch when pushing the die in toward the punch side to mold side walls. Accordingly, slack portions (linear excess portions) arise in the metal sheet blank between shoulders of the punch-side pad and shoulders of the punch. These slack portions (linear excess portions) are slightly curved toward a front face side of the metal sheet blank.

The die-side pad and the die are then pushed further in toward the punch side to mold a top plate of the press-molded article. When this is performed, portions of the metal sheet blank that have been bent by the shoulders of the punch are pushed out toward a base end side of the side walls and become the side walls. A first moment toward the inside of the press-molded article therefore arises at a base end portion of each side wall of the press-molded article after demolding (see the arrow in FIG. 5(*b*) in Patent Document 2).

The slack portions (linear excess portions) are ultimately squashed between the punch and the die. However, prior to being squashed, each slack portion (linear excess portion) deforms by slightly curving so as to protrude toward the front face side of the metal sheet blank. A second moment toward the inside of the press-molded article therefore arises at both width direction end portions of the top plate of the press-molded article after demolding (see the arrow in FIG. 5(*b*) in Patent Document 2).

A third moment toward the outside of the press-molded article arises at ridge line portions of the press-molded article after demolding (see the arrow in FIG. 5(*b*) in Patent Document 2). However, the third moment is canceled out by the first and second moments, enabling spring-back of the press-molded article to be suppressed.

SUMMARY OF INVENTION

Technical Problem

However, in the above press-molded article manufacturing methods, the first and second moments both become greater as the projection amount of the punch-side pad from the punch increases. In response thereto, an amount of displacement of the side walls toward the inside (spring-go amount) also increases. The width direction dimensions of the side walls therefore too sensitively change in response to the projection amount of the punch-side pad from the punch.

A range of punch-side pad projection amounts in which the width direction dimensions of the side walls can be kept within a set tolerance is therefore comparatively narrow. This necessitates precise adjustment of the punch-side pad projection amount when press molding. It is thus desirable in a manufacturing method for a press-molded article to be able to mold a press-molded article in which the dimensions of side walls fall within a tolerance, even when a range of punch-side pad projection amounts is enlarged.

In consideration of the above circumstances, an object of the present disclosure is to provide a press-molded article manufacturing method and a press apparatus capable of securing dimensional precision of a press-molded article even with an enlarged range of projection amounts of an inner pad from a punch.

Solution to Problem

In order to solve the above problem, a manufacturing method of a press-molded article is a method that uses a press apparatus, configured including a punch equipped with an inner pad at an apex portion of the punch and a die equipped with a die pad disposed opposing the inner pad, to manufacture a metal sheet blank into a press-molded article including a top plate, a pair of ridge line portions positioned at both width direction sides of the top plate, and a pair of side walls extending from the ridge line portions toward one plate thickness direction side of the top plate. The press-molded article manufacturing method includes: a first process of projecting the inner pad, from the punch toward a side of the die and disposing a metal sheet blank on the inner pad such that one plate thickness direction side of the metal sheet blank is on the inner pad side, and also projecting the die pad, from the die toward a side of the punch and disposing the die pad at a position separated from the inner pad by a predetermined distance that is greater than a plate thickness of the metal sheet blank; a second process of moving the die toward a side of the punch relative to the die pad, the inner pad, and the punch, forming the side walls using the die and the punch, and integrating the die pad with the die; and a third process of moving the die and the die pad, which have been integrated, and the inner pad, toward a side of the punch relative to the punch to form the top plate.

According to the press-molded article manufacturing method to solve the above problem, a metal sheet blank is employed to manufacture a press-molded article. The press-molded article includes the top plate, the pair of ridge line portions positioned at both width direction sides of the top plate, and the pair of side walls extending from the ridge line portions toward one plate thickness direction side of the top plate.

Then, in the first process, the inner pad is projected from the punch toward the die side and the metal sheet blank is disposed on the inner pad such that one plate thickness direction side of the metal sheet blank is on the inner pad side. Moreover, the die pad is projected from the die toward the a side of punch and the die pad is disposed so as to be separated from the inner pad by the predetermined distance that is greater than the plate thickness of the metal sheet blank.

In the second process, the die is moved toward the punch side relative to the die pad, the inner pad, and the punch, the side walls are formed in the metal sheet blank using the die and the punch, and the die pad and the die are integrated together. Moreover, in the third process, the die and the die pad that have been integrated together, and the inner pad, are moved toward the punch side relative to the punch to form the top plate in the metal sheet blank. A press-molded article is thereby molded.

In this manner, in the press-molded article manufacturing method of the present disclosure, the die pad is disposed separated from the inner pad by the predetermined distance that is greater than the plate thickness of the metal sheet blank. Then, in this state, the die is moved toward the punch side relative to the die pad, the inner pad, and the punch, and the side walls are formed in the metal sheet blank. Thus, generation of the second moment referred to above in the press-molded article after molding can be suppressed.

Namely, when the die is moved relatively toward the punch side in the second process, and the metal sheet blank is pushed by both the shoulders of the die (edges of the die cavity), the die pad is disposed so as to be separated by the predetermined distance from the inner pad. This enables flexing to be generated in a portion the metal sheet blank between the die pad and the inner pad, and enables the flexing toward the die pad side to be adjusted.

Thus, for example, setting the predetermined distance such that the portion of the metal sheet blank between the die pad and the inner pad flexes within its resilient range, enables the suppression of plastic deformation into a curved profile of the portion of the metal sheet blank corresponding to the slack portions referred to above. This enables generation of the second moment referred to above in the press-molded article after demolding to be suppressed.

Namely, this enables moments arising in the press-molded article to be, in the main, a first moment at base end portions of the side walls toward the inside of the press-molded article, and a third moment at ridge line portions toward the outside of the press-molded article. In other words, influence from the second moment on the amount of displacement of the side walls in the width direction is suppressed, enabling the amount of displacement of the side walls in the width direction to be adjusted by using mainly the first moment alone.

This enables opening of the side walls of the press-molded article (angle at the shoulders (ridge line portions 10B)) to be suppressed from too sensitively changing in response to the projection amount of the inner pad from the punch, enabling the range of projection amounts of the inner pad from the punch to be enlarged. As a result, this enables the suppression of a phenomenon in which the amount of displacement of the side walls toward the inside of the press-molded article become exceedingly large as the projection amount of the inner pad increases. Thus, a press-molded article that maintains the dimensional precision of the side walls within a tolerance can be molded even for an enlarged range of projection amount of the inner pad from the punch. Namely, the projection amount of the inner pad from the punch in a press apparatus is easier to manage.

The press-molded article manufacturing method of the present disclosure enables the dimensional precision of the press-molded article to be secured even for an enlarged range of the projection amount of the inner pad from the punch.

DESCRIPTION OF EMBODIMENTS

First Exemplary Embodiment

Figure 1A:
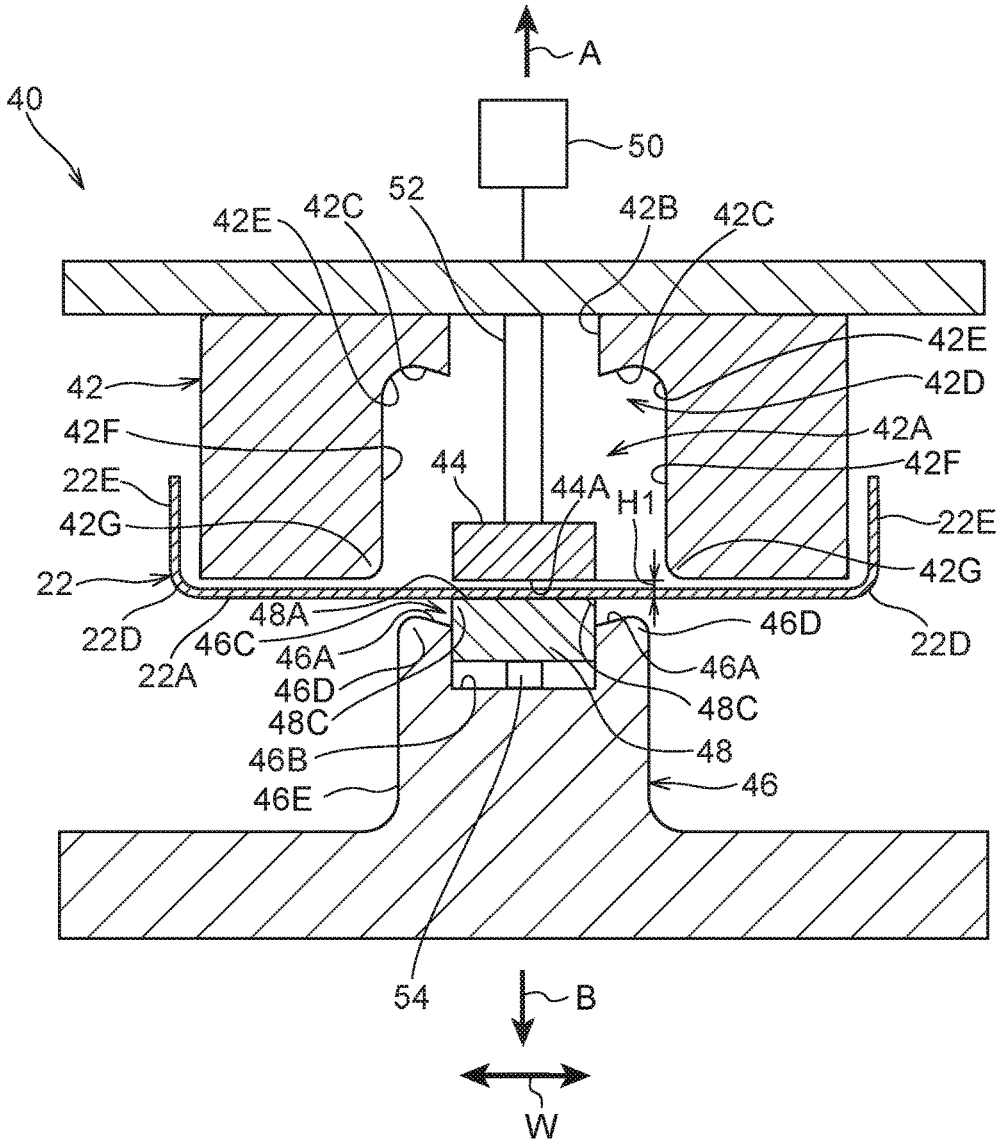
FIG. 1A is a cross-section in front view of a press apparatus, illustrating a first process of a press-molded article manufacturing method according to a first exemplary embodiment.

Explanation follows regarding a press-molded article manufacturing method according to a first exemplary embodiment, with reference to FIG. 1 to FIG. 11. In this press-molded article manufacturing method, a metal sheet blank 20 is molded into a press-molded article 10, this being a final molded article. The metal sheet blank 20 employed in the first exemplary embodiment has been pre-processed.

First, explanation follows regarding configuration of the press-molded article 10, followed by explanation regarding the pre-processing of the metal sheet blank 20 and the press-molded article manufacturing method. Note that in the drawings, equivalent members and the like are allocated the same reference numerals, and in the subsequent explanation, explanation will be omitted as appropriate where equivalent members have already been described.

Press-Molded Article 10

Figure 4:
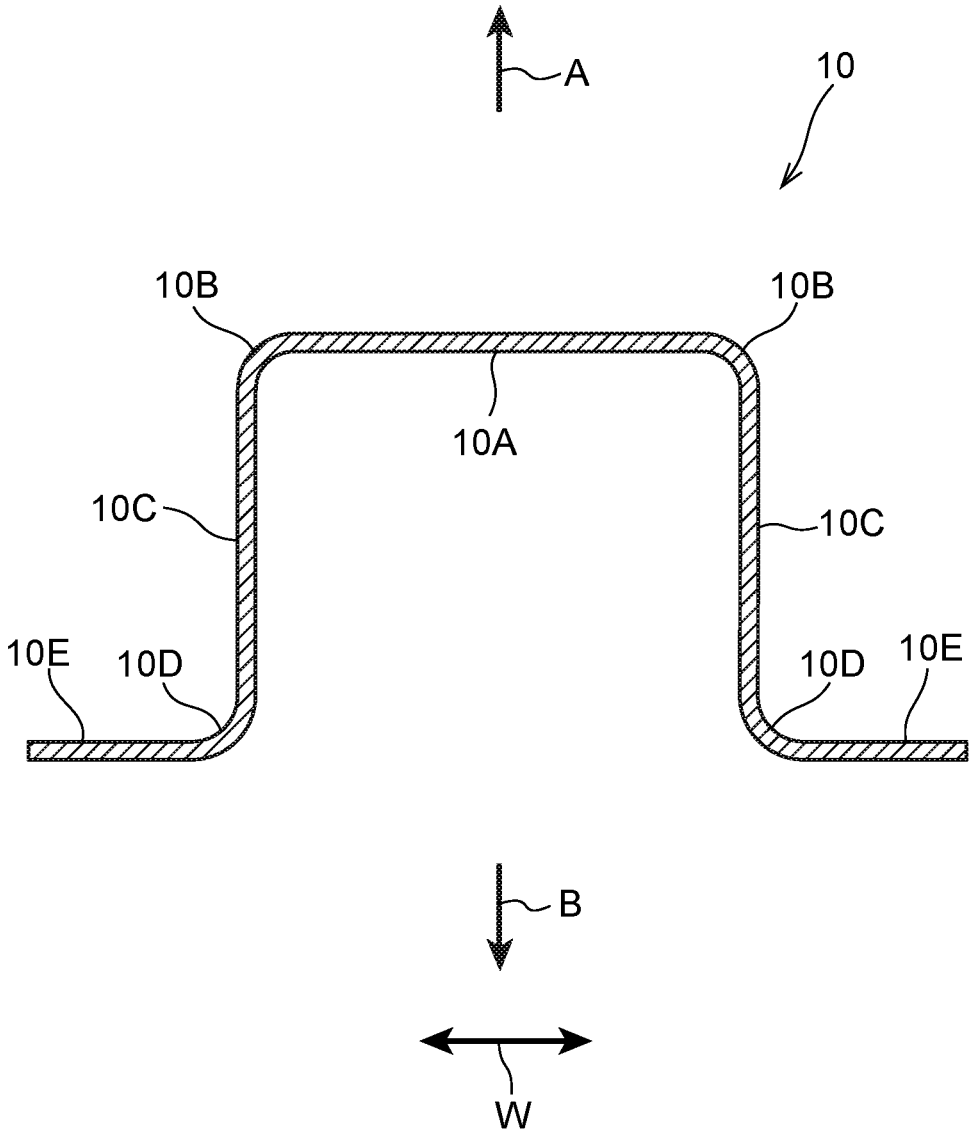
FIG. 4 is a cross-section in front view illustrating a press-molded article molded using the press apparatus of FIG. 1A.

Explanation follows regarding configuration of the press-molded article 10, with reference to FIG. 4. Note that in FIG. 4, arrow W indicates the width direction of the press-molded article 10, arrow A indicates the upper side of the press-molded article 10, and arrow B indicates the lower side of the press-molded article 10. Arrow A and arrow B each indicate the pressing direction.

The press-molded article 10 is, for example, configured from high-strength sheet steel having a tensile strength of 440 MPa or greater. Spring-back becomes more apparent the higher the tensile strength. The press-molded article 10 is, for example, employed as a vehicle body framework member configuring automobile framework and having a substantially elongated shape. The press-molded article 10 is formed with a substantially hat-shaped cross-section profile in front view as viewed from one length direction side.

Specifically, the press-molded article 10 includes a top plate 10A extending in the width direction of the press-molded article 10, and a pair of ridge line portions 10B adjacent to the top plate 10A at both width direction ends of the top plate 10A and curved into arc shapes convex toward a front face side. The press-molded article 10 further includes a pair of side walls 10C, extending from the respective ridge line portions 10B toward a back face side, this being one plate thickness direction side, of the top plate 10A, and a pair of ridge line portions 10D adjacent to leading ends (lower ends) of the pair of side walls 10C and curved into arc shapes convex toward the back face side. The press-molded article 10 further includes a pair of flanges 10E extending from the pair of ridge line portions 10D toward both width direction sides of the top plate 10A (front face sides of the side walls 10C).

Note that in the following explanation, the back face side of the press-molded article 10, this being the one plate thickness direction side thereof, is referred to as the inside of the press-molded article 10, and the front face side of the press-molded article 10, this being the other plate thickness direction side thereof, is referred to as the outside of the press-molded article 10. As described above, the pair of ridge line portions 10B form boundaries between the top plate 10A and the side walls 10C, and configure bent portions convex toward the outside of the press-molded article 10 in front view.

Pre-Processing Metal Sheet Blank 20

Next, explanation follows regarding pre-processing of the metal sheet blank 20. Note that in the following explanation, a metal sheet blank prior to pre-processing is given the reference number 20 and the metal sheet blank after pre-processing is given the reference number 22, in order to distinguish between the metal sheet blank prior to pre-processing and the metal sheet blank after pre-processing. The metal sheet blank after pre-processing is referred to as an intermediate molded article 22.

Figure 5:
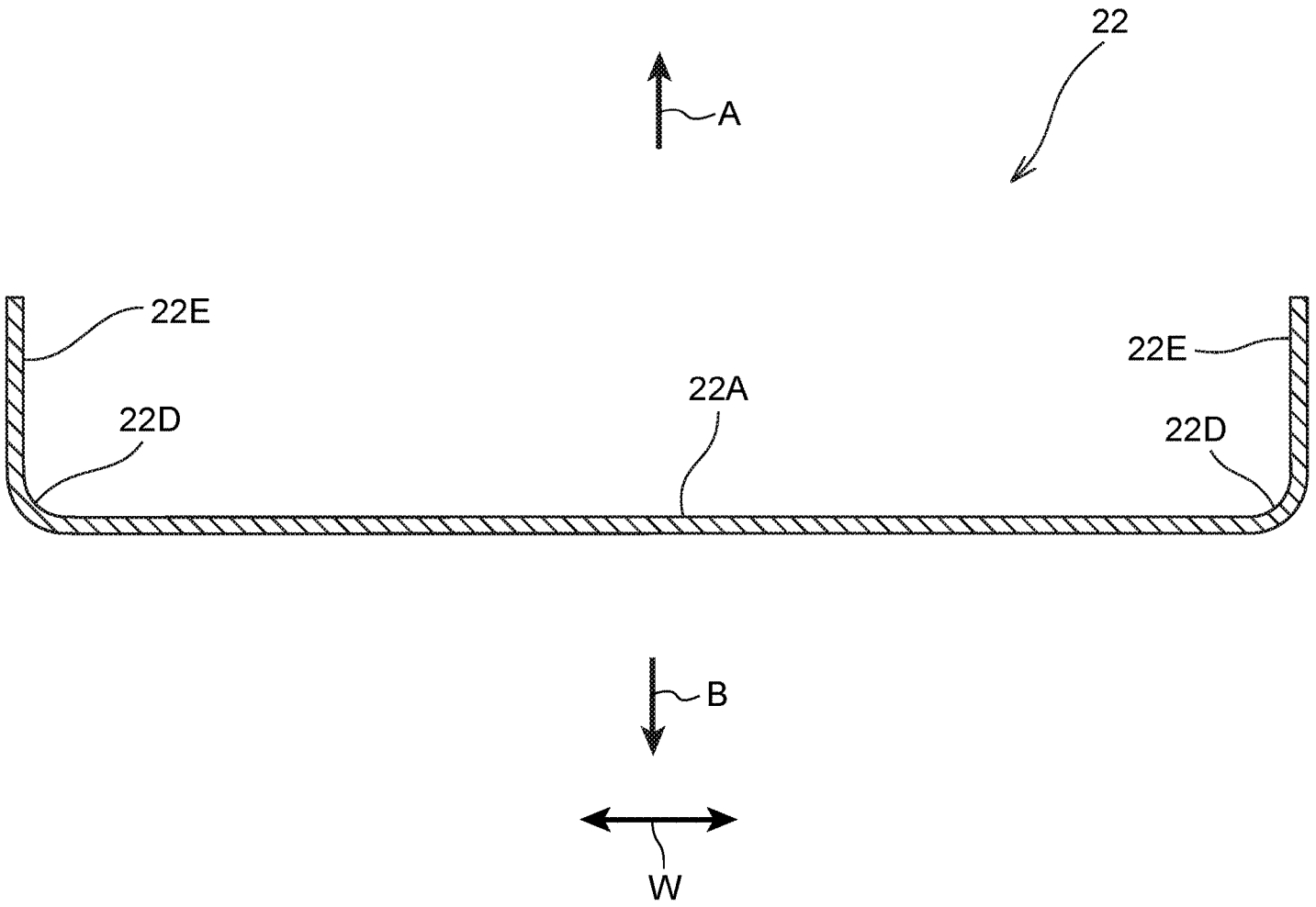
FIG. 5 is a cross-section in front view illustrating a pre-processed metal sheet blank.

First, explanation follows regarding configuration of the intermediate molded article 22 after pre-processing, with reference to FIG. 5. Note that in FIG. 5, arrow W indicates the width direction of the intermediate molded article 22, arrow A indicates the upper side of the intermediate molded article 22, and arrow B indicates the lower side of the intermediate molded article 22. The width direction of the intermediate molded article 22 is aligned with the width direction of the press-molded article 10, and the up-down direction of the intermediate molded article 22 is aligned with the up-down direction of the press-molded article 10.

As illustrated in this drawing, the intermediate molded article 22 is pre-formed with portions corresponding to the ridge line portions 10D and the flanges 10E of the press-molded article 10 respectively. Namely, the intermediate molded article 22 is formed with a substantially U-shaped profile opening toward the upper side in cross-section viewed from the front. Specifically, the intermediate molded article 22 includes a body 22A forming a width direction intermediate portion of the intermediate molded article 22, ridge line portions 22D that are adjacent to both width direction ends of the body 22A and correspond to the ridge line portions 10D, and flanges 22E that correspond to the flanges 10E.

Figure 6A:
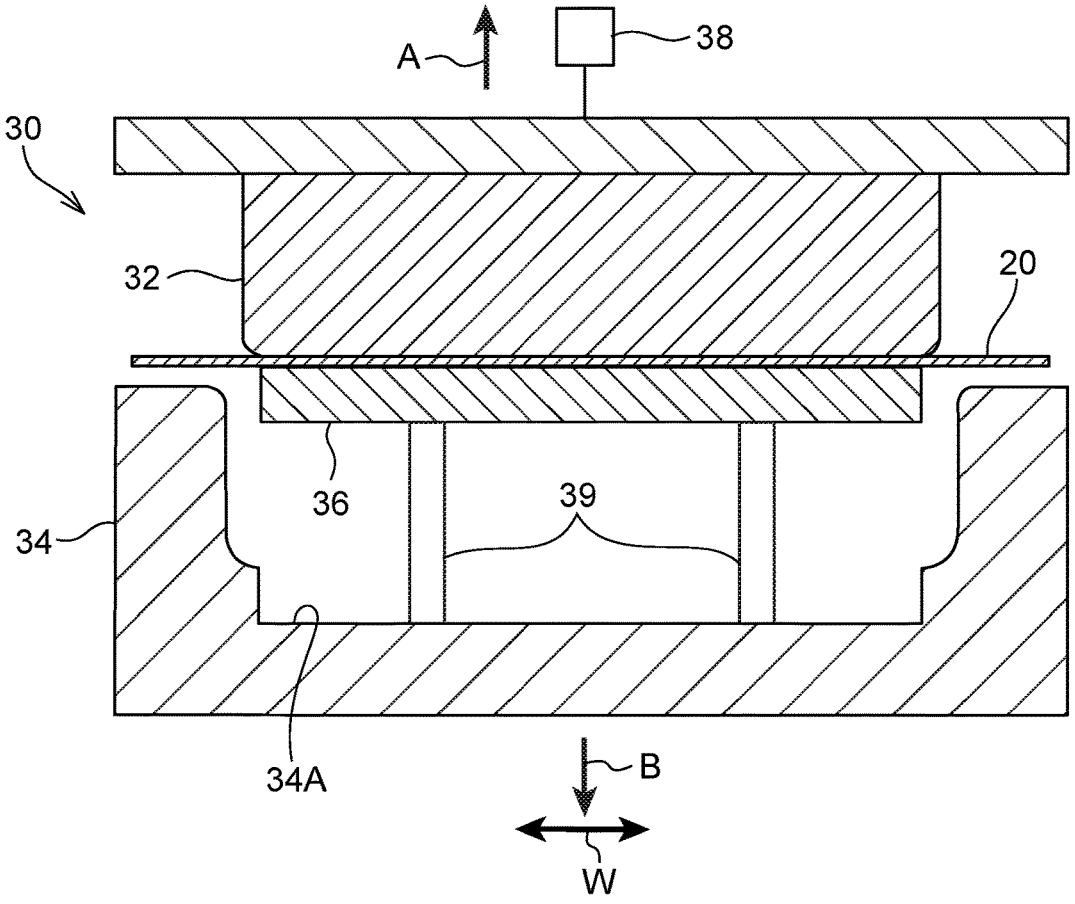
FIG. 6A is a cross-section in front view of a press apparatus, illustrating a first pre-processing process performed when pre-processing a metal sheet blank.
Figure 6B:
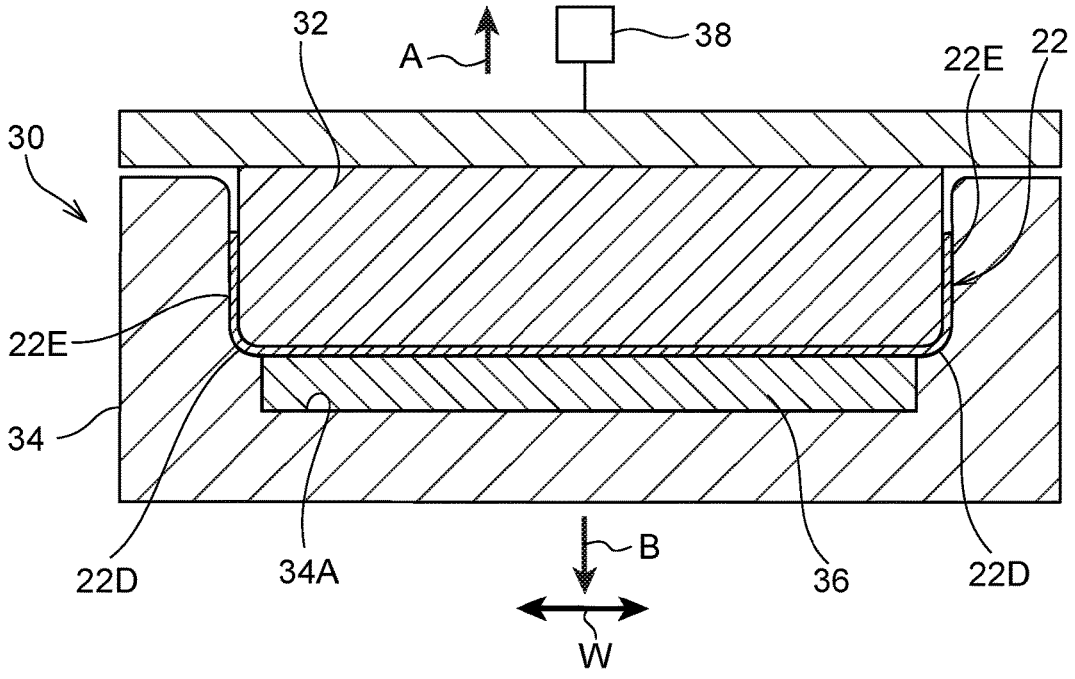
FIG. 6B is a cross-section in front view of a press apparatus, illustrating a second pre-processing process performed when pre-processing a metal sheet blank.

FIG. 6A and FIG. 6B are diagrams illustrating a press apparatus 30 used in pre-processing. The press apparatus 30 performs pre-processing on the metal sheet blank 20. Note that in FIG. 6A and FIG. 6B, arrow W indicates the width direction of the press apparatus 30, arrow A indicates the apparatus upper side of the press apparatus 30, and arrow B indicates the apparatus lower side of the press apparatus 30. The width direction of the press apparatus 30 is aligned with the width direction of the intermediate molded article 22, and the apparatus up-down direction of the press apparatus 30 is aligned with the up-down direction of the intermediate molded article 22.

The press apparatus 30 includes a punch 32 configuring an apparatus upper side section of the press apparatus 30 and a die 34 configuring an apparatus lower side section of the press apparatus 30. The die 34 includes a pad 36 disposed at a width direction central portion of the die 34.

The punch 32 includes molding faces corresponding to the front face side profile of the body 22A, the ridge line portions 22D, and the flanges 22E of the intermediate molded article 22. A moving device 38 is coupled to the punch 32. The moving device 38 may, as an example, be configured by a hydraulic device, an electrically powered device, or the like. The punch 32 is moved, by the moving device 38, in the apparatus up-down direction (pressing direction), namely a direction approaching the die 34 and a direction away from the die 34.

The die 34 includes molding faces corresponding to the back face side profile of the ridge line portions 22D and the flanges 22E of the intermediate molded article 22. A width direction central portion of the die 34 is formed with a recess 34A that houses the pad 36. The recess 34A opens toward the apparatus upper side, this being the punch 32 side.

The pad 36 is disposed at the apparatus lower side of the punch 32, and an upper face of the pad 36 is orthogonal to the apparatus up-down direction. The pad 36 is coupled to the die 34 through a pad pressing device 39. The pad pressing device 39 may, for example, be configured by a gas cushion, hydraulic device, springs, or an electrically powered device. The pad 36 is thus moved in the apparatus up-down direction (pressing direction) relative to the die 34 by the pad pressing device 39. At the bottom dead center of the pad 36, where the pad 36 is closest to the die 34, the pad 36 is housed in the recess 34A of the die 34 (see FIG. 6B).

Next, explanation follows regarding a pre-processing process in which the press apparatus 30 pre-processes the metal sheet blank 20. In this pre-processing, as illustrated in FIG. 6A, the pad 36 is retained by the pad pressing device 39 in a state so as to project toward the apparatus upper side with respect to the die 34 (a state in which an upper face of the pad 36 projects from a die cavity), and the metal sheet blank 20 is set on the pad 36. The punch 32 is moved by the moving device 38 toward the apparatus lower side so as to approach the pad 36, such that a width direction central side portion of the metal sheet blank 20 is pressed and held by the punch 32 and the pad 36.

Then, in a state in which the metal sheet blank 20 is pressed and held by the punch 32 and the pad 36, the moving device 38 moves the punch 32 toward the apparatus lower side relative to the die 34. The pad 36 is also pushed by the punch 32 and moves toward the apparatus lower side relative to the die 34 while the metal sheet blank 20 remains pressed and held by the punch 32 and the pad 36. As illustrated in FIG. 6B, when the punch 32 and the pad 36 reach the bottom dead center, the metal sheet blank 20 is pressed and held by the punch shoulders of the punch 32 and the corners (bottom corners) of the die cavity of the die 34. The pair of ridge line portions 22D and the flanges 22E of the intermediate molded article 22 are thus formed. The metal sheet blank 20 is pre-processed in the above manner so as to be molded into the intermediate molded article 22.

Press-Molded Article 10 Manufacturing Method

Next, explanation follows regarding the manufacturing method of the press-molded article 10. In the manufacturing method of the press-molded article 10, a press apparatus 40 is employed to mold the pre-processed intermediate molded article 22 into the press-molded article 10. First, explanation follows regarding the press apparatus 40, with reference to FIG. 1 to FIG. 3.

In FIG. 1 to FIG. 3, arrow W indicates the width direction of the press apparatus 40, arrow A indicates the apparatus upper side of the press apparatus 40, and arrow B indicates the apparatus lower side of the press apparatus 40. The width direction of the press apparatus 40 is aligned with the width directions of the press-molded article 10 and the intermediate molded article 22, and the apparatus up-down direction (pressing direction) of the press apparatus 40 is aligned with the up-down directions of the press-molded article 10 and the intermediate molded article 22.

The press apparatus 40 includes a die 42 configuring an apparatus upper side section of the press apparatus 40, and a punch 46 configuring an apparatus lower side section of the press apparatus 40. The die 42 and the punch 46 are disposed opposing each other along the apparatus up-down direction.

A recess 42A is formed at a width direction central portion of the die 42, as an example of a die cavity opening toward the apparatus lower side. A die bottom 42D is formed inside the recess 42A at an apparatus upper side, so as to oppose an apex portion 46C of the punch 46. A pad housing portion 42B, serving as an example of a die pad housing portion, is formed in the die bottom 42D. The pad housing portion 42B has a concave profile opening toward the apparatus lower side. The pad housing portion 42B houses a die pad 44, described later. An inner peripheral face of the recess 42A, except at the pad housing portion 42B, is a molding face corresponding to front faces of both width direction side portions of the top plate 10A, the ridge line portions 10B, the side walls 10C, and the ridge line portions 10D of the press-molded article 10.

Bottom corners 42E are formed on both sides of the die bottom 42D so as to correspond to shoulders 46D (described later) of the punch 46. By a portion of the punch and a portion of the die corresponding to each other, means that the portion of the punch and the portion of the die oppose each other when at the molding bottom dead center. The bottom corners 42E are molding faces corresponding to the ridge line portions 10B of the press-molded article 10. The bottom corners 42E preferably have a shape inverted in contour from that of the shoulders 46D of the punch 46. A die cavity wall face 42F corresponding to a punch wall face 46E of the punch 46 extends from each of the bottom corners 42E.

The die bottom 42D of the die 42 is formed with inclined faces 42C, serving as an example of die-side inclined faces, that project from each of the bottom corners 42E further toward the punch 46 side on progression toward the pad housing portion 42B. The respective inclined faces 42C are adjacent to the pad housing portion 42B on both width direction sides.

Moreover, the die 42 is coupled to a moving device 50. The moving device 50 may, for example, be configured by a hydraulic device or an electrically powered device. A controller 56 (see FIG. 1B) is connected to the moving device 50. The controller 56 actuates the moving device 50 such that the die 42 is moved by the moving device 50 in the apparatus up-down direction. The die 42 accordingly moves relative to the punch 46 in directions approaching and departing from the punch 46. Moreover, both shoulders 42G of the die 42 abut the intermediate molded article 22 as the die 42 approaches the punch 46.

The die pad 44 is provided at a width direction central portion of the die 42. The die pad 44 is formed in a substantially rectangular block shaped profile in cross-section viewed from the front. The die pad 44 includes a lower face 44A, serving as an example of an inner pad-opposing face that opposes an upper face 48A of an inner pad 48. In cases in which a contoured profile is formed on the top plate of a press-molded article, contours corresponding to the profile of the press-molded article are provided on the lower face 44A.

The die pad 44 is coupled to the die 42 through a pad pressing device 52, serving as an example of a second coupling device. The pad pressing device 52 may, for example, be configured by a hydraulic device or an electrically powered device. The pad pressing device 52 is connected to the controller 56 (see FIG. 1B). The controller 56 actuates the pad pressing device 52. The pad pressing device 52 moves the die pad 44 in the apparatus up-down direction relative to the die 42, so as to move the die pad 44 in the pressing direction. The controller 56 thereby uses the pad pressing device 52 to modify a pressing direction spacing between the die pad 44 and the die 42.

The controller 56 controls the position of the die pad 44 relative to the die 42. The controller 56 thereby controls the relative position of the die pad 44 with respect to the inner pad 48, described later. The die pad 44 is housed inside the pad housing portion 42B (see FIG. 2B) in a state in which the die pad 44 is at its closest to the die 42. In the housed state of the die pad 44 inside the pad housing portion 42B, the lower face 44A of the die pad 44 is positioned at the apparatus upper side of an opening face of the pad housing portion 42B, and the lower face 44A does not project from the pad housing portion 42B toward the apparatus lower side (i.e. is indented).

The punch 46 is disposed at the apparatus lower side of the die 42 and the die pad 44, and opposes the die 42 and the die pad 44 in the apparatus up-down direction. The punch 46 is formed with a convex profile projecting toward the apparatus upper side in cross-section in front view. An outer face of the punch 46 configures a molding face that corresponds to the back faces of both width direction side portions of the top plate 10A, the ridge line portions 10B, the side walls 10C, the ridge line portions 10D, and the flanges 10E of the press-molded article 10.

The punch 46 includes the apex portion 46C that forms an upper face of the punch 46 intersecting the pressing direction. The apex portion 46C is formed with a pad housing portion 46B, serving as an example of an inner pad housing portion. Both sides of the apex portion 46C are formed with the shoulders 46D, serving as an example of punch shoulders. The punch wall faces 46E extend from the respective shoulders 46D.

The apex portion 46C of the punch 46 is formed with inclined faces 46A, serving as an example of punch-side inclined faces, that are more indented on progression from the shoulders 46D toward the pad housing portion 46B. The inclined faces 46A oppose the inclined faces 42C of the die 42 in the apparatus up-down direction. Namely, the respective inclined faces 46A are parallel to the respective inclined faces 42C, and are inclined toward the apparatus lower side on progression from the shoulders 46D toward the width direction central side of the punch 46.

The pad housing portion 46B has a concave profile opening toward the apparatus upper side. The pad housing portion 46B houses the inner pad 48, described later. The inclined faces 46A are adjacent to the pad housing portion 46B on both sides.

The inner pad 48 is provided at a width direction central portion of the apex portion 46C of the punch 46. The inner pad 48 has a substantially rectangular block shaped cross-section in front view. The inner pad 48 is coupled to the punch 46 through a pad pressing device 54, serving as an example of a first coupling device. The pad pressing device 54 may, for example, be configured by a hydraulic device, an electrically powered device, or the like.

Figure 1B:
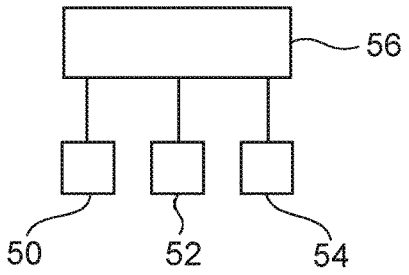
FIG. 1B is a block diagram of a controller that controls actuation of a moving device and a pad pressing device illustrated in FIG. 1A.

The pad pressing device 54 is connected to the controller 56 (see FIG. 1B). The controller 56 actuates the pad pressing device 54 such that the pad pressing device 54 moves the inner pad 48 in the apparatus up-down direction relative to the punch 46. The controller 56 thereby modifies a pressing direction spacing between the inner pad 48 and the punch 46 using the pad pressing device 54.

Namely, the controller 56 controls the position of the inner pad 48 relative to the punch 46. In a state in which the inner pad 48 is closest to the punch 46, the inner pad 48 is housed inside the pad housing portion 46B (see FIG. 3B).

The inner pad 48 is disposed opposing the die pad 44 in the apparatus up-down direction. The inner pad 48 includes the upper face 48A, serving as an example of an inner pad apex face. The upper face 48A is parallel to the lower face 44A of the die pad 44. Similarly to the lower face 44A, a contoured profile corresponding to that of the press-molded article is also provided to the upper face 48A in cases in which the top plate of the press-molded article has a contoured profile. A width dimension of the inner pad 48 matches a width dimension of the die pad 44. In a state in which the inner pad 48 is housed inside the pad housing portion 46B, the upper face 48A of the inner pad 48 is in the same plane as an opening face of the pad housing portion 46B (see FIG. 3B). Accordingly, in a state in which the inner pad 48 is housed inside the pad housing portion 46B, the apex portion 46C of the punch 46, including the inner pad 48, configures a concave profile indented toward the apparatus lower side.

The amount by which the apex portion 46C of the punch 46 is indented represents the up-down dimension in the apparatus up-down direction from the shoulders 46D of the punch 46 to the upper face 48A of the inner pad 48. This indented amount is set as appropriate such that the top plate 10A of the press-molded article 10 adopts a flat profile (flat plate shape) when the press-molded article 10 has been demolded from the press apparatus 40. Namely, the indented amount of the apex portion 46C of the punch 46 is set as appropriate using, for example, simulations according to the tensile strength, plate thickness, and the like of the metal sheet blank employed for the press-molded article 10.

Figure 9:
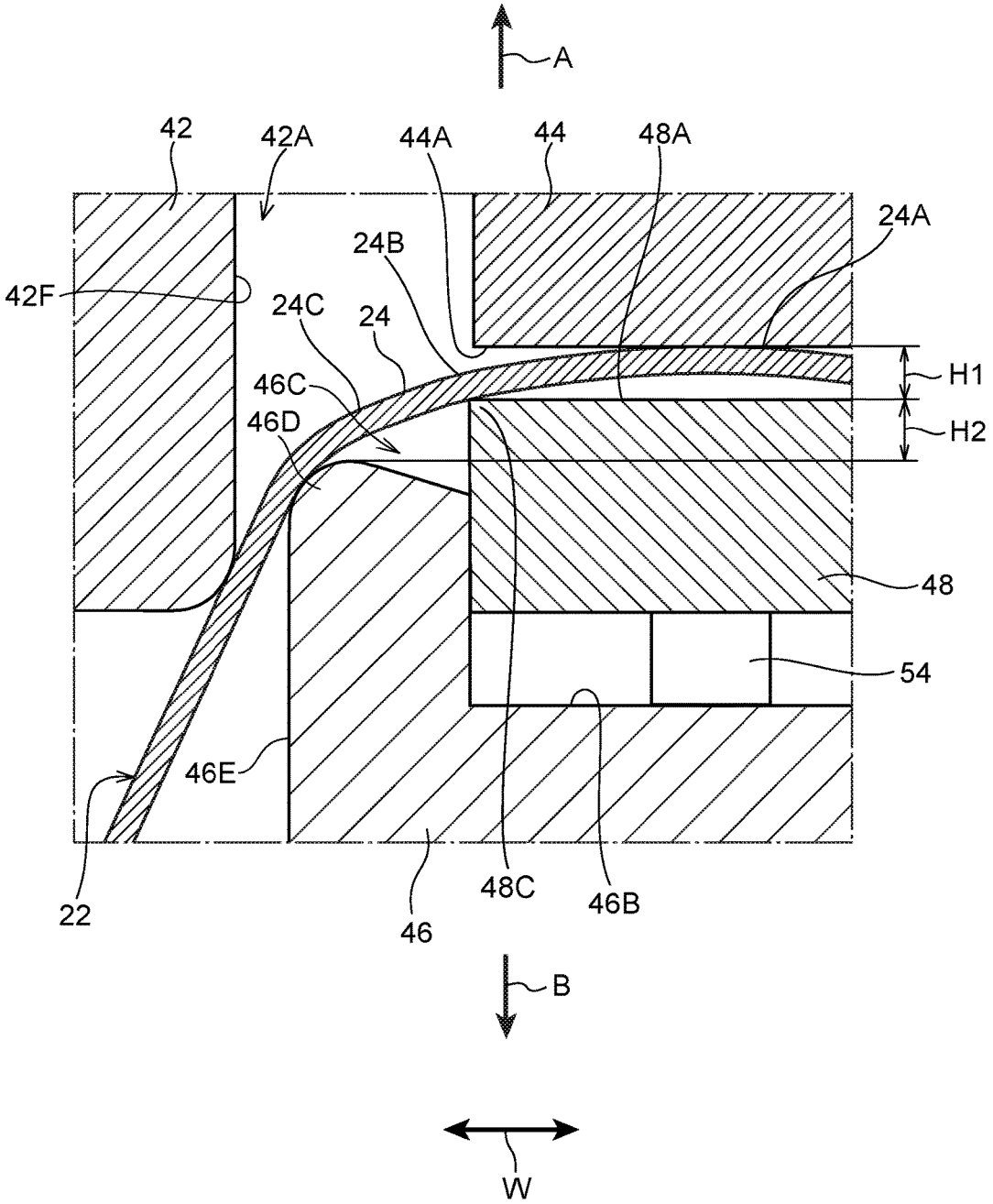
FIG. 9 is an enlarged cross-section of the vicinity of a punch shoulder illustrated in FIG. 2A.

As illustrated in FIG. 1A and FIG. 9, in a first process to a third process of the press-molded article manufacturing method, described later, the controller 56 actuates the pad pressing devices 52, 54 so that the die pad 44 is retained at a predetermined distance H1 to the apparatus upper side of the inner pad 48. The predetermined distance H1 is greater than the plate thickness of the intermediate molded article 22, such that a gap is created between the intermediate molded article 22 and the lower face 44A of the die pad 44. The predetermined distance H1 will be described later. The reference number 48C is used to indicate shoulders 48C of the inner pad 48.

Next, explanation follows regarding the manufacturing method of the press-molded article 10. The manufacturing method of the press-molded article 10 includes the first process to the third process described below.

As illustrated in FIG. 1A and FIG. 1B, in the first process, the controller 56 actuates the pad pressing device 54, and the inner pad 48 is retained by the pad pressing device 54 in a state projecting from the pad housing portion 46B toward the apparatus upper side. The inner pad 48 projects from the shoulders 46D of the punch 46 by a projection amount H2. In this state, the back face of the intermediate molded article 22 is set on the upper face 48A of the inner pad 48. The controller 56 then actuates the pad pressing device 52 such that the die pad 44 is moved by the pad pressing device 52 out from the pad housing portion 42B toward the apparatus lower side, such that the die pad 44 is disposed at the apparatus upper side of the intermediate molded article 22. When this is performed, the die pad 44 is retained in a state separated from the inner pad 48 by the predetermined distance H1. A gap is thus created between the intermediate molded article 22 and the lower face 44A of the die pad 44.

Figure 2A:
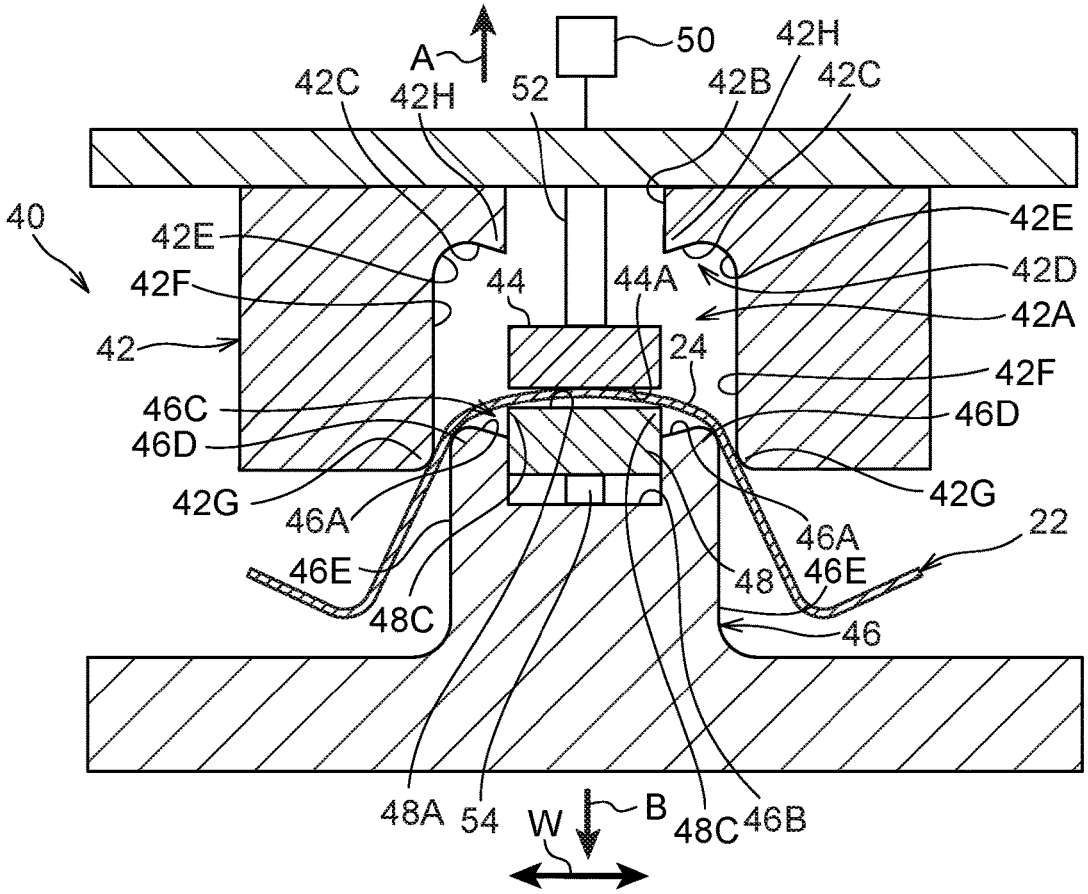
FIG. 2A is a cross-section in front view of a press apparatus, illustrating a second process of a press-molded article manufacturing method according to a first exemplary embodiment.

In the second process, the controller 56 actuates the moving device 50 and the pad pressing device 52 to move the die 42 from the state illustrated in FIG. 1A toward the apparatus lower side (the punch 46 side) relative to the die pad 44, the inner pad 48, and the punch 46 (see FIG. 2A). When this is performed, the predetermined distance H1 between the die pad 44 and the inner pad 48 is maintained, and the die 42 is moved toward the apparatus lower side while maintaining the relative positional relationship between the die pad 44 and the inner pad 48 in the apparatus up-down direction. The punch 46 is thus pushed inside the recess (die cavity) 42A of the die 42, thereby molding the side walls 10C of the press-molded article 10.

The intermediate molded article 22 is then pushed toward the apparatus lower side by both shoulders 42G of the die 42. When this is performed, a width direction central portion of the intermediate molded article 22, at a position between locations abutted by both shoulders 42G of the die 42, flexes in a curve convex toward the apparatus upper side. The portion flexed so as to be convex configures a flexing portion 24 (see FIG. 2A).

When this is performed, the back face of the flexing portion 24 abuts the shoulders 48C of the inner pad 48 and both shoulders 46D of the punch 46, and the front face of the flexing portion 24 abuts the lower face 44A of the die pad 44.

In the following explanation, as illustrated in FIG. 9, a portion of the flexing portion 24 between both shoulders 48C of the inner pad 48 configures a first flexing portion 24A. Portions that abut the shoulders 48C of the inner pad 48 configure second flexing portions 24B, and portions between the shoulders 48C of the inner pad 48 and the punch 46 configure third flexing portions 24C.

Note that in the present exemplary embodiment, the dimension of the predetermined distance H1 is set so as to suppress plastic deformation of the third flexing portions 24C of the flexing portion 24 in the second process. More specifically, the predetermined distance H1 is set to the maximum dimension at which the first flexing portion 24A is capable of flexing within its resilient range.

In related technology, in the second process, the die pad 44 is not separated from the intermediate molded article 22. In such cases, the intermediate molded article 22 is pressed and held by the die pad 44 and the inner pad 48. The punch 46 is then pushed inside the recess 42A of the die 42 while in this state, so as to mold the side walls 10C of the press-molded article 10. When this occurs, flexing of the first flexing portion 24A toward the apparatus upper side is not permitted. As a result, flexing is concentrated at the second flexing portions 24B and the third flexing portions 24C alone. There is thus a possibility that the third flexing portions 24C may bend toward the apparatus lower side about the second flexing portions 24B and be plastically deformed into a slightly curved state so as to be convex on the front face side of the intermediate molded article 22.

By contrast, in the present exemplary embodiment, the die pad 44 is separated from the intermediate molded article 22, and flexing of the first flexing portion 24A toward the apparatus upper side is permitted. Since the entire flexing portion 24 flexes at the first flexing portion 24A, the second flexing portions 24B, and the third flexing portions 24C, the flexing of the third flexing portions 24C is reduced in comparison to in the case described above. Moreover, the predetermined distance H1 is set to the maximum dimension at which the first flexing portion 24A is capable of flexing within its resilient range. This thereby enables the flexing of the third flexing portions 24C to be reduced even further, thereby enabling plastic deformation of the third flexing portions 24C to be suppressed.

The predetermined distance H1 is set as appropriate using simulations and the like based on the tensile strength and plate thickness of the metal sheet blank 20, the respective width dimensions of the inner pad 48 and the punch 46, and the projection amount H2 of the inner pad 48 from the shoulders 46D of the punch 46.

Figure 2B:
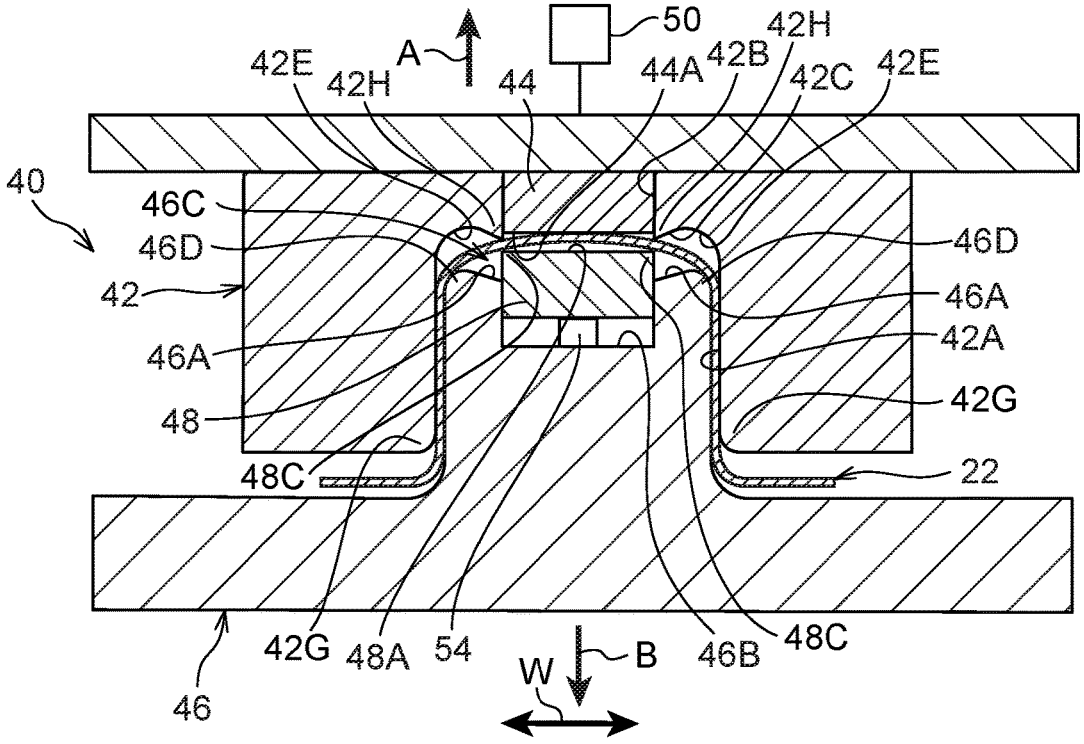
FIG. 2B is a cross-section in front view of a press apparatus, illustrating a state in which a die has been moved relatively toward a punch side from the state illustrated in FIG. 2A, and the die and a die pad have been integrated together.

Moreover, as illustrated in FIG. 2B, in the second process the die 42 is moved toward the apparatus lower side until the die pad 44 is housed inside the pad housing portion 42B, and the die 42 and the die pad 44 are then integrated together. The die pad 44 is thus in a state in which it is not able to move in the apparatus upward direction relative to the die 42. In the present specification, integrating the die pad and the die together refers to placing the die pad 44 in a state in which it is not able to move in the apparatus upward direction relative to the die 42.

When the die pad and the die have been integrated together, the lower face 44A of the die pad 44 is housed inside the pad housing portion 42B and does not project from the pad housing portion 42B toward the apparatus lower side. The flexing portion 24 of the intermediate molded article 22 is sandwiched between lower end portions 42H formed at width direction inside end portions of the inclined faces 42C of the die 42, and the inner pad 48.

In the third process, the controller 56 actuates the moving device 50 to move the die 42 and the die pad 44 that have been integrated together further toward the apparatus lower side, and to push the die 42 and the die pad 44 in toward the punch 46 side. When this is performed, the controller 56 actuates the pad pressing device 54, moving the inner pad 48 toward the apparatus lower side together with the die 42 and the die pad 44, while maintaining the relative positional relationship between the die pad 44 and the inner pad 48 in the apparatus up-down direction. Accordingly, the majority of the inner pad 48 is housed inside the pad housing portion 46B (see FIG. 3A). When this is performed, the inner pad 48 is housed inside the pad housing portion 46B such that the flexing portion 24 of the intermediate molded article 22 adopts a flat profile (flat plate shape). The flexing portion 24 that was flexed so as to be convex toward the apparatus upper side is thereby returned to a flat profile (flat plate shape) by the die 42 and the inner pad 48.

Figure 3A:
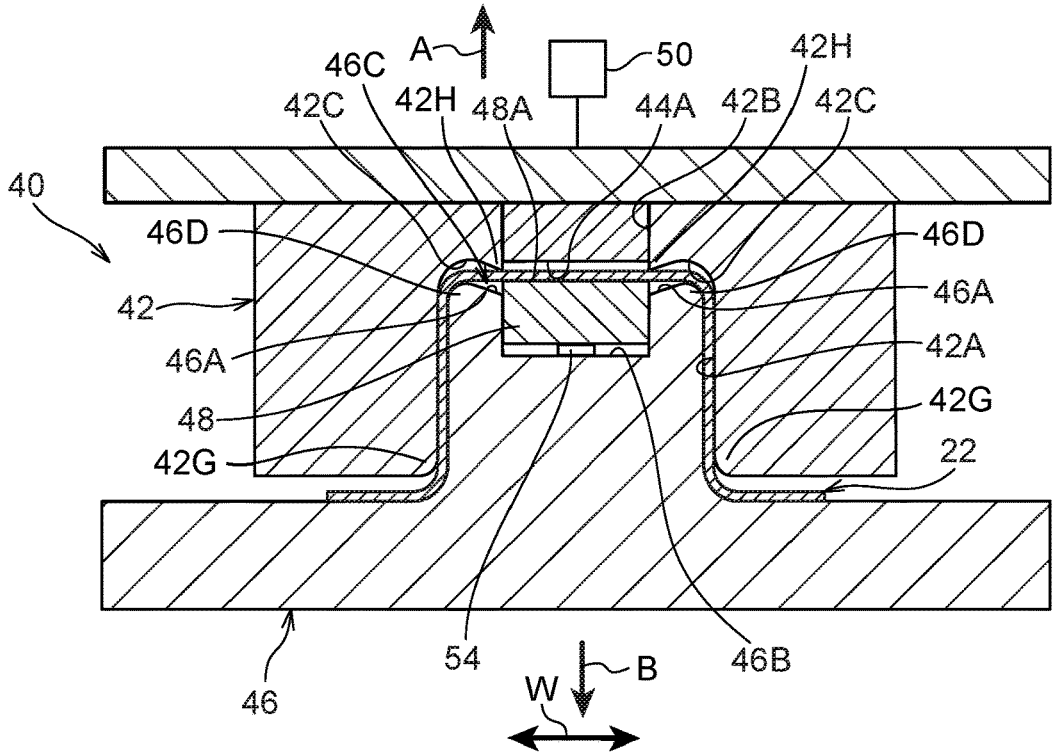
FIG. 3A is a cross-section in front view of a press apparatus, illustrating a state in which the die and the die pad have relatively moved further toward the punch side from the state illustrated in FIG. 2B.

The controller 56 then actuates the moving device 50, and the die 42 and the die pad 44 that have been integrated together are moved by the moving device 50 further toward the apparatus lower side from the state illustrated in FIG. 3A, so as to reach the bottom dead center. When this is performed, the controller 56 actuates the pad pressing device 54 so as to move the inner pad 48 toward the apparatus lower side together with the die 42 and the die pad 44, while maintaining the relative positional relationship between the die pad 44 and the inner pad 48 in the apparatus up-down direction, such that the entire inner pad 48 is housed inside the pad housing portion 46B (see FIG. 3B).

Accordingly, the intermediate molded article 22 is pressed and held by the die 42 and the punch 46 so as to warp a portion of the intermediate molded article 22 corresponding to the top plate 10A so as to be convex toward the back face side of the intermediate molded article 22 (the inside of the press-molded article 10). Specifically, the flexing portion 24 is pressed and held by the inclined faces 42C of the die 42 and the inclined faces 46A of the punch 46, thereby bending back the second flexing portions 24B of the flexing portion 24. The press-molded article 10 is then demolded from the press apparatus 40 to obtain the press-molded article 10 provided with the flat plate shaped top plate 10A.

Next, explanation follows regarding operation and advantageous effects of the present exemplary embodiment, while drawing comparison to a manufacturing method of a comparative example described in related art. First, explanation follows regarding the press-molded article manufacturing method of the comparative example. In the press-molded article manufacturing method of the comparative example, an intermediate molded article 22 is employed to mold a press-molded article 10, similarly to in the present exemplary embodiment.

Figure 7:
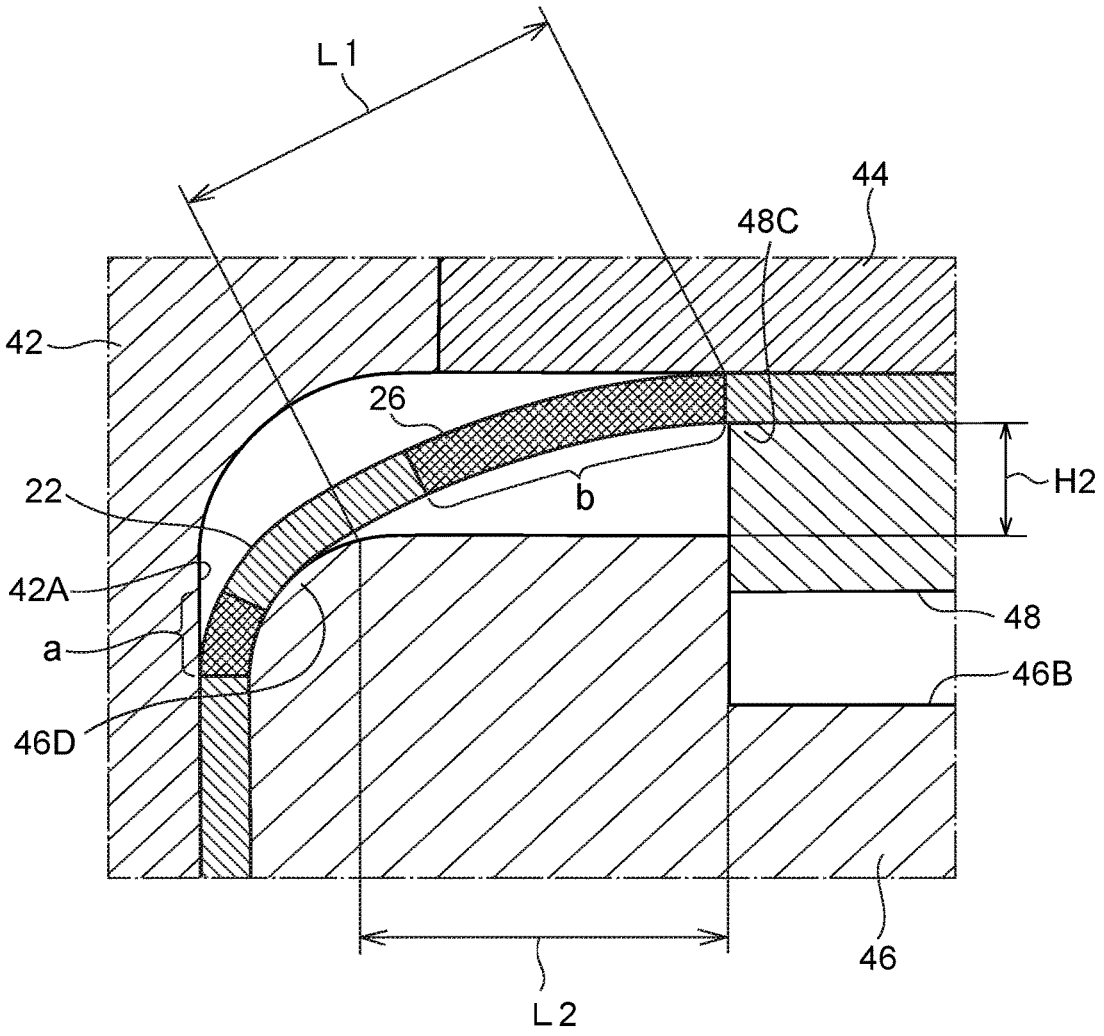
FIG. 7 is a cross-section illustrating the vicinity of a punch shoulder in a latter part of a second process of a press-molded article manufacturing method of a comparative example.

FIG. 7 is an enlarged diagram of the surroundings of a shoulder 46D of a punch 46 in a press apparatus of the comparative example. Note that in FIG. 7, portions of the press apparatus of the comparative example configured similarly to those in the present exemplary embodiment are allocated the same reference numerals. Moreover, portions in the press apparatus of the comparative example equivalent to the inclined faces 42C of the die 42 and the inclined faces 46A of the punch 46 are orthogonal to the apparatus up-down direction.

Unlike in the first process of the present exemplary embodiment, when the die pad 44 has been moved toward the apparatus lower side by the pad pressing device 52 in a first process of the comparative example, the intermediate molded article 22 is pressed and held by the die pad 44 and the inner pad 48. Namely, in the first process of the comparative example, there is no gap created between the intermediate molded article 22 and the die pad 44.

In a second process of the comparative example, in this state, portions corresponding to the side walls 10C of the press-molded article 10 are molded by pushing the die 42 in toward the punch 46 side. When this is performed, the inner pad 48 projects toward the die 42 side with respect to the punch 46. Accordingly, portions of the intermediate molded article 22 from the shoulders 48C of the inner pad 48 to the shoulders 46D of the punch 46 (hereafter: slack portions 26) are bent so as to be inclined toward the apparatus lower side on progression toward the width direction outside of the press apparatus. Specifically, the slack portions 26 are plastically deformed in a slightly curved state so as to be convex toward the front face side of the intermediate molded article 22.

The length L1 along each slack portion 26 is longer than a length L2 between the inner pad 48 and the corresponding shoulder 46D of the punch 46 in the width direction. Accordingly, when the die 42 and the die pad 44 move from the state in FIG. 7 to the bottom dead center, the slack portions 26 are pressed and held by the die 42 and die pad 44, and the punch 46. The portion bent by each shoulder 46D of the punch 46 (the portion a in FIG. 7) is pushed out toward the apparatus lower side to become part of the side wall 10C. A portion on the inner pad 48 side of each slack portion 26 (the portion b in FIG. 7) is squashed to become part of the top plate 10A.

Figure 8:
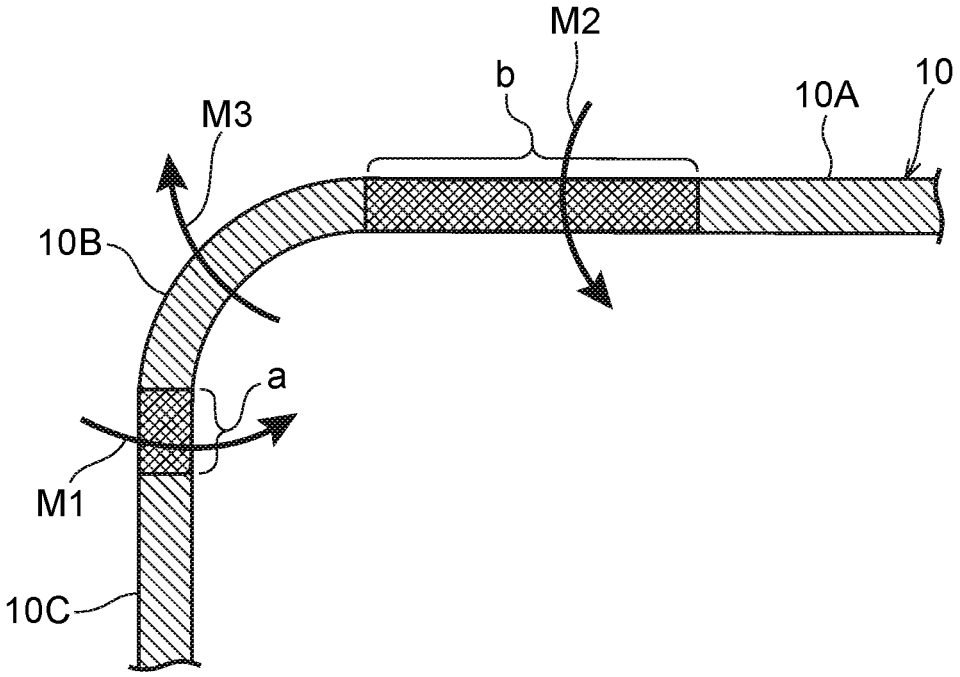
FIG. 8 is a cross-section to explain moments arising in the vicinity of a ridge line portion of a press-molded article.

Namely, as illustrated in FIG. 8, in the press-molded article 10 of the comparative example, the portions a form base end portions of the side walls 10C and the portions b form two width direction side portions of the top plate 10A. The portions a that have been pushed out to the side wall 10C sides are bent by the shoulders 46D of the punch 46 into arc profiles convex toward the outside of the press-molded article 10, and are then bent back as the side walls 10C. After demolding the press-molded article 10, the portions a of the press-molded article 10 therefore attempt to return to a state bent into an arc profile. A first moment (see arrow M1 in FIG. 8) toward the inside of the press-molded article 10 accordingly arises at each of the portions a of the press-molded article 10.

The portions b of the slack portions 26 are deformed into a slightly curved state so as to be convex toward the outside of the press-molded article 10 (the front face side of the intermediate molded article 22), and are then given a flat plate shape as the top plate 10A (are bent back). After demolding of the press-molded article 10, the portions b of the press-molded article 10 therefore attempt to return to a curved state. A second moment (see arrow M2 in FIG. 8) toward the inside of the press-molded article 10 accordingly arises in each of the portions b of the press-molded article 10.

Portions of the press-molded article 10 between each portion a and the corresponding portion b, namely the ridge line portions 10B of the press-molded article 10, are bent by the shoulders 46D of the punch 46 into arc profiles convex toward the outside of the press-molded article 10. After demolding of the press-molded article 10, the ridge line portions 10B attempt to return to their original state. A third moment (see arrow M3 in FIG. 8) toward the outside of the press-molded article 10 accordingly arises in the ridge line portions 10B of the press-molded article 10.

As described above, spring-back of the press-molded article 10 is suppressed in the comparative example due to the canceling out (balancing out) between the first and second moments arising at the portions a and portions b of the press-molded article 10, and the third moment arising at the ridge line portions 10B of the press-molded article 10. However, in the manufacturing method of the comparative example, the greater the projection amount H2 of the inner pad 48 from the punch 46, the greater the amount of bending for the slack portions 26, and there is a greater amount of curvature of the slack portions 26 so as to be convex toward the front face side of the intermediate molded article 22. The greater the projection amount H2 of the inner pad 48 from the punch 46, the greater the first moment arising at the portions a of the press-molded article 10 and the second moment generated at the portions b of the press-molded article 10. A displacement amount of the side walls 10C toward the inside of the press-molded article 10 accordingly becomes greater. In other words, as both the first and second moments increase, the dimensions of the side walls 10C in the width direction too sensitively change in response to the projection amount H2 of the inner pad 48 from the punch 46. As a result, this makes a narrow range (a difference between the upper limit and lower limit) for the projection amount H2 of the inner pad 48 from the punch 46 that keeps the side walls 10C within a tolerance of a design dimension after molding.

By contrast, as described above, the present exemplary embodiment differs from the comparative example in the point that in the first process, the die pad 44 is retained at a position at the apparatus upper side of the intermediate molded article 22 and the inner pad 48, such that the die pad 44 is separated from the inner pad 48 by the predetermined distance H1.

Moreover, the predetermined distance H1 between the die pad 44 and the inner pad 48 is maintained in the second process. The die 42 is then moved toward the apparatus lower side while maintaining the relative positional relationship between the die pad 44 and the inner pad 48 in the apparatus up-down direction. Accordingly, as illustrated in FIG. 9, the first flexing portion 24A of the flexing portion 24 of the intermediate molded article 22 flexes in a convex state toward the apparatus upper side, and the upper end of the first flexing portion 24A abuts the lower face 44A of the die pad 44.

However, the predetermined distance H1 is set such that the first flexing portion 24A flexes within its resilient range. Accordingly, the third flexing portions 24C can be suppressed from deforming within its plastic range as in the comparative example.

In a case in which, unlike in the present exemplary embodiment, the intermediate molded article 22 were to be pressed and held by the die pad 44 and the inner pad 48 similarly to in the comparative example, flexing of the first flexing portion 24A of the flexing portion 24 toward the apparatus upper side would not be permitted in the second process. This would mean that, similarly to in the comparative example, the third flexing portions 24C of the flexing portion 24 would plastically deform to a slightly curved state so as to be convex toward the front face side of the intermediate molded article 22. By contrast, the present exemplary embodiment differs from the comparative example in the point that the die pad 44 is separated from the intermediate molded article 22. Accordingly, flexing of the first flexing portion 24A toward the apparatus upper side is permitted, and flexing of the third flexing portions 24C is less than cases in which the intermediate molded article 22 is pressed and held by the die pad 44 and the inner pad 48. Moreover, the predetermined distance H1 is set to the maximum dimension at which the first flexing portion 24A is capable of flexing within its resilient range. Flexing of the third flexing portions 24C is thus further reduced, enabling plastic deformation of the third flexing portions 24C to be suppressed. Accordingly, the occurrence of the second moment toward the inside of the press-molded article 10 at the portions b can be suppressed in the press-molded article 10 after demolding.

Accordingly, in the main, the first moment toward the inside of the press-molded article 10 arising at the portions a, and the third moment toward the outside of the press-molded article 10 arising at the ridge line portions 10B cancel each other out (balance each other out), enabling spring-back of the press-molded article 10 to be suppressed. Namely, influence of the second moment on the amount of displacement of the side walls 10C in the width direction can be suppressed, which enables the amount of displacement of the side walls 10C in the width direction to be adjusted in the main by the first moment alone.

This thereby enables the dimensions of the side walls 10C in the width direction to be suppressed from too sensitively changing in response to changes in the projection amount H2 of the inner pad 48 from the punch 46. The range (difference between the upper limit and lower limit) can accordingly be enlarged for the projection amount H2 of the inner pad 48 from the punch 46 that keeps the side walls 10C after molding within the tolerance of the design dimension.

As described above, the press-molded article 10 can be molded while maintaining the dimensional precision of the side walls 10C within the tolerance, even with an enlarged range of the projection amount H2 of the inner pad 48 from the punch 46. Namely, the projection amount H2 is easier to manage.

Figure 10:
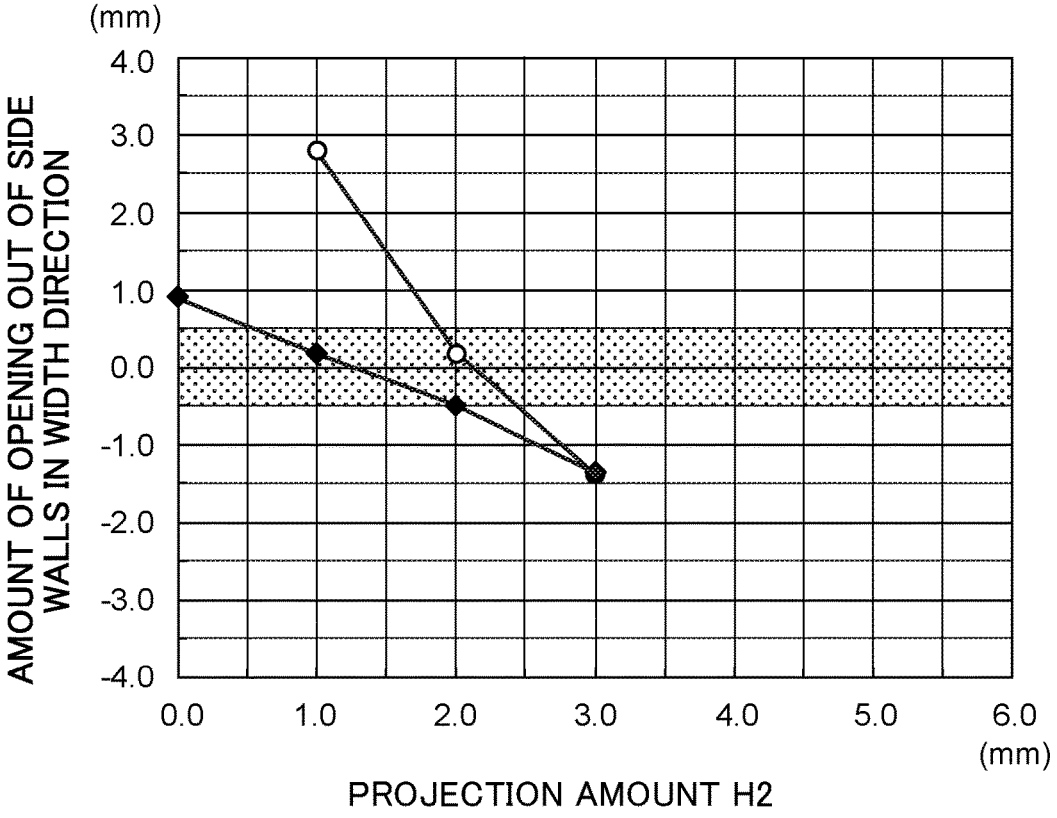
FIG. 10 is a graph illustrating relationships between a projection amount of an inner pad from a punch, and the amount of misalignment of a side wall from a design dimension.
Figure 11:
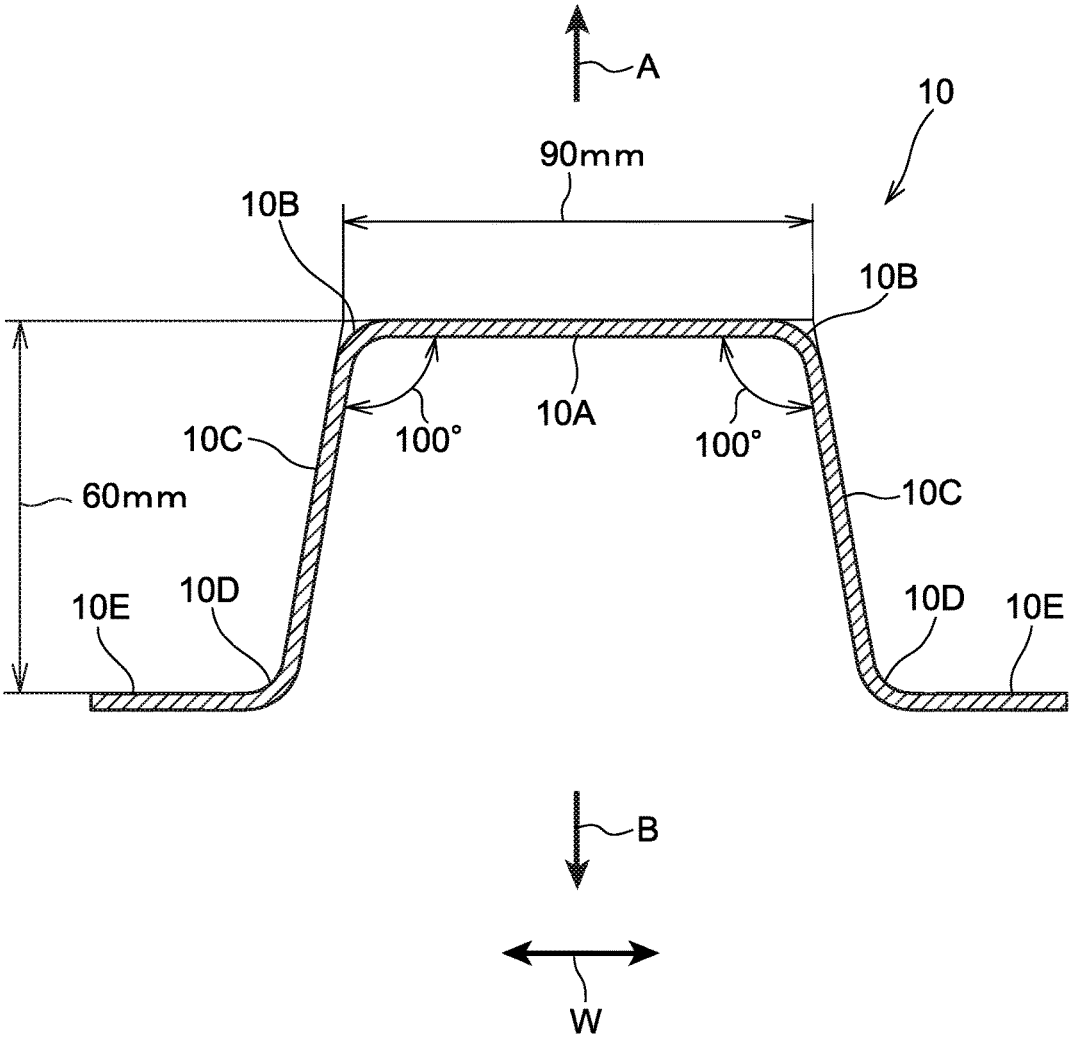
FIG. 11 is a cross-section in front view illustrating dimensional relationships in a press-molded article employed in order to obtain the simulation results illustrated in the graph of FIG. 10.

Explanation follows regarding this point, with reference to the graph illustrated in FIG. 10. This graph illustrates simulation results for when the press-molded article 10 illustrated in FIG. 11 is molded using the respective manufacturing methods of the comparative example and the present exemplary embodiment. The graph illustrates a relationship between the projection amount H2 of the inner pad 48 from the punch 46 and the position of a leading end portion of one of the side walls 10C in the width direction of the press-molded article 10.

First, explanation follows regarding each of the dimensions of the press-molded article 10 illustrated in FIG. 11. The width dimension of the press-molded article 10 at the top plate 10A side is set in this press-molded article 10 to 90 mm, and an up-down dimension of the press-molded article 10, namely the up-down dimension from the front face of the top plate 10A to the front faces of the flanges 10E, is set to 60 mm. The angle formed between the top plate 10A and the side walls 10C of the press-molded article 10 is set to 100°. Moreover, the press-molded article 10 is configured by high-strength sheet steel with a plate thickness of 1.4 mm and a tensile strength of 1180 MPa.

In the graph illustrated in FIG. 10, the horizontal axis shows a projection amount H2 (mm) of the inner pad 48 from the shoulders 46D of the punch 46, and the vertical axis shows the position of the leading end portion of one side wall 10C of the press-molded article 10.

Note that the vertical axis indicates the amount of misalignment (amount of variation) (mm) in the width direction of the side wall 10C with respect to the design dimension of the side wall 10C. Namely, the positive side on the vertical axis indicates that the side wall 10C is positioned toward the width direction outside of the design dimension (position) when demolded after molding, and the negative side on the vertical axis indicates that the side wall 10C is positioned toward the width direction inside of the design dimension (position) when demolded after molding.

Moreover, in this graph, the dotted range indicates a region within the tolerance of the design dimension of the one side wall 10C. Namely, in the present exemplary embodiment, the tolerance with respect to the design dimension of the one side wall 10C is set to ±0.5 mm. Furthermore, the points in the graph shown by white circles indicate data for the comparative example, and the points shown by black squares indicate data for the present exemplary embodiment. Moreover, in the present exemplary embodiment illustrated in FIG. 10, the predetermined distance H1 is set to 2.4 mm. Namely, the up-down dimension of the gap between the intermediate molded article 22 and the die pad 44 in the first process is set to 1.0 mm.

As is apparent from the graph, in the press-molded article 10 of the comparative example, the greater the projection amount H2 of the inner pad 48 from the shoulders 46D of the punch 46, the larger the amount of displacement of the side wall 10C in the width direction toward the inside of the press-molded article 10. In other words, for the comparative example, it is apparent that the slope of a line connecting the data points is negative. When the absolute value of the slope of the line connecting the data points is large, the range is narrower for the projection amount H2 for which the side walls 10C will fall within the tolerance of the design dimension. In the comparative example, in order to mold the side wall 10C within the tolerance of the design dimension, the projection amount H2 needs to be set approximately between 1.9 mm and 2.5 mm, giving a permissible range of variation in the projection amount H2 for manufacturing purposes of approximately 0.6 mm. Namely, to manufacture the press-molded article 10, the position of the inner pad 48 with respect to the punch 46 in the press apparatus 40 needs to be adjusted to within the permissible range of variation in the projection amount H2 (within a range of 0.6 mm).

By contrast, in the present exemplary embodiment, as illustrated by the graph in FIG. 10, the absolute value of the slope of the line connecting the data points is gentler than that of the comparative example. Moreover, in the present exemplary embodiment, the projection amount H2 to mold the side wall 10C within the tolerance of the design dimension is approximately from 0.5 mm to 2.0 mm. The permissible range of variation of the projection amount H2 for manufacturing purposes can thus be enlarged to approximately 1.5 mm. Accordingly, the press-molded article manufacturing method of the present exemplary embodiment enables the range (difference between the upper limit and lower limit) to be enlarged for the projection amount H2 of the inner pad 48 from the punch 46 that keeps the side wall 10C within the tolerance of the design dimension in the width direction after molding. Moreover, in the press apparatus 40, a contribution can be made to improving productivity for the press-molded article 10 due to enlarging the inner pad 48 adjustment range.

Moreover, in the present exemplary embodiment, the apex portion 46C of the punch 46 in the press apparatus 40 is formed with the inclined faces 46A that are more indented on progression from the shoulders 46D of the punch 46 toward the width direction center side of the punch 46. The lower face of the die 42 is formed with the inclined faces 42C that are disposed opposing the inclined faces 46A and that run parallel to the inclined faces 46A.

This enables the intermediate molded article 22 to be pressed and held by the die 42 and the punch 46 such that in the third process, the portion of the intermediate molded article 22 corresponding to the top plate 10A is warped so as to be convex toward the back face side of the intermediate molded article 22 (the inside of the press-molded article 10). This effectively enables the top plate 10A of the press-molded article 10 to be configured in a flat plate shape.

This will now be explained in detail. In the second process of the comparative example and the present exemplary embodiment, the second flexing portions 24B of the flexing portion 24 abut the shoulders 48C of the inner pad 48, and the second flexing portions 24B flex so as to curve convex toward the apparatus upper side. Accordingly, there is a possibility of an ingrained bend that is convex toward the front face side of the intermediate molded article 22 arising at the second flexing portions 24B in the second process.

However, in the present exemplary embodiment, the inclined faces 46A are formed to the apex portion 46C of the punch 46, and the inclined faces 42C are formed to the lower face of the die 42. Accordingly, even supposing an ingrained bend were to occur in the second flexing portions 24B of the flexing portion 24, such ingrained bending of the second flexing portions 24B can be bent back in the third process. This effectively enables the top plate 10A of the press-molded article 10 to be configured in a flat plate shape.

Moreover, in the present exemplary embodiment, from the first process until completion of the third process, the die pad 44 is maintained in a state separated from the inner pad 48 by the predetermined distance H1. Namely, the relative positional relationship between the die pad 44 and the inner pad 48 is maintained from the first process until completion of the third process, and in the third process, the lower face 44A of the die pad 44 is disposed inside the pad housing portion 42B. This thereby enables the lower face 44A of the die pad 44 to be suppressed from projecting from the pad housing portion 42B toward the apparatus lower side due to dimensional variation or the like in the die 42 and the die pad 44. This thereby enables the portions of the intermediate molded article 22 corresponding to both width direction sides of the top plate 10A to be pressed and held well the die 42 and the punch 46 in the third process.

Second Exemplary Embodiment

Figure 12:
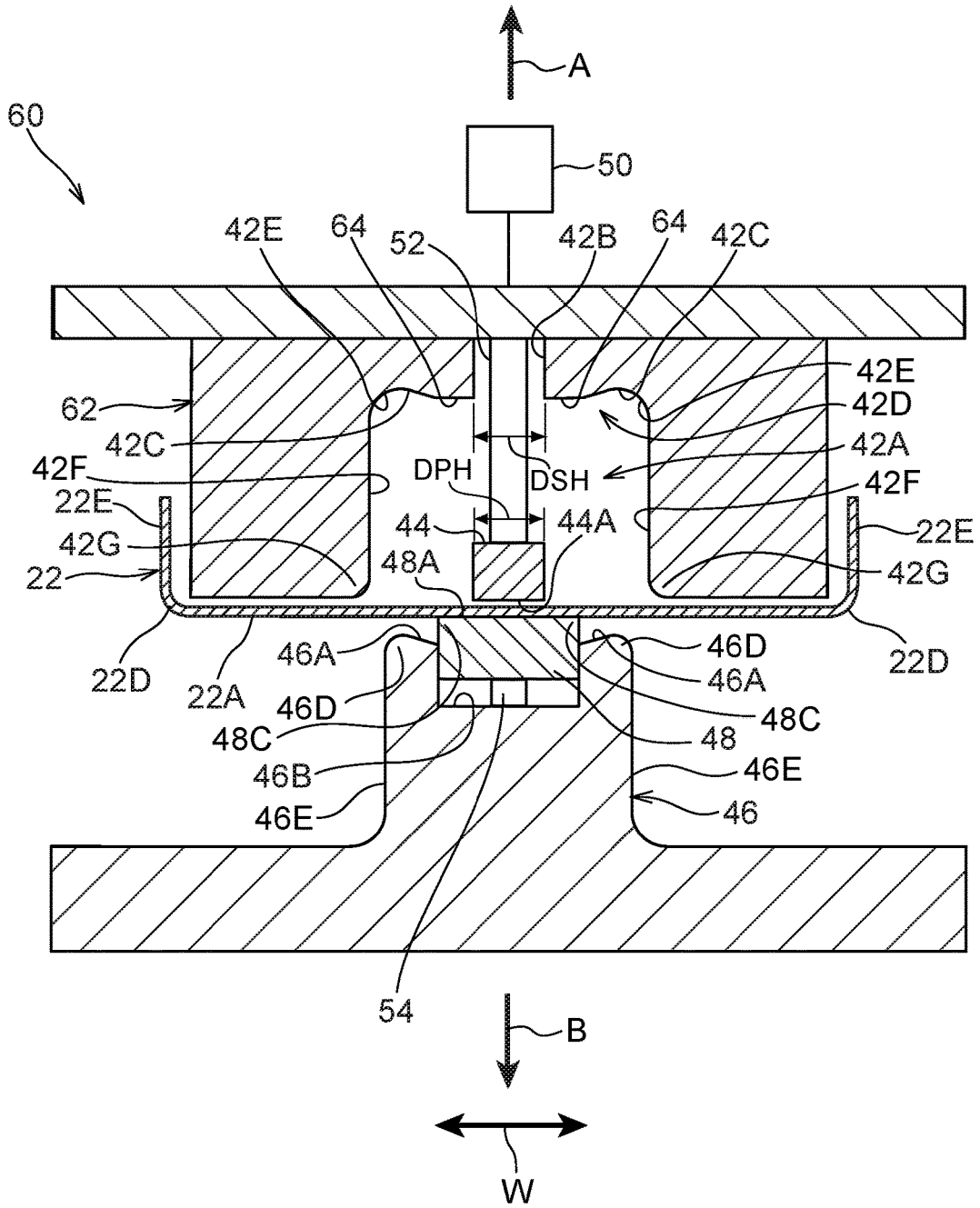
FIG. 12 is a cross-section in front view of a press apparatus, illustrating a state in a first process of a press-molded article manufacturing method according to a second exemplary embodiment.
Figure 13A:
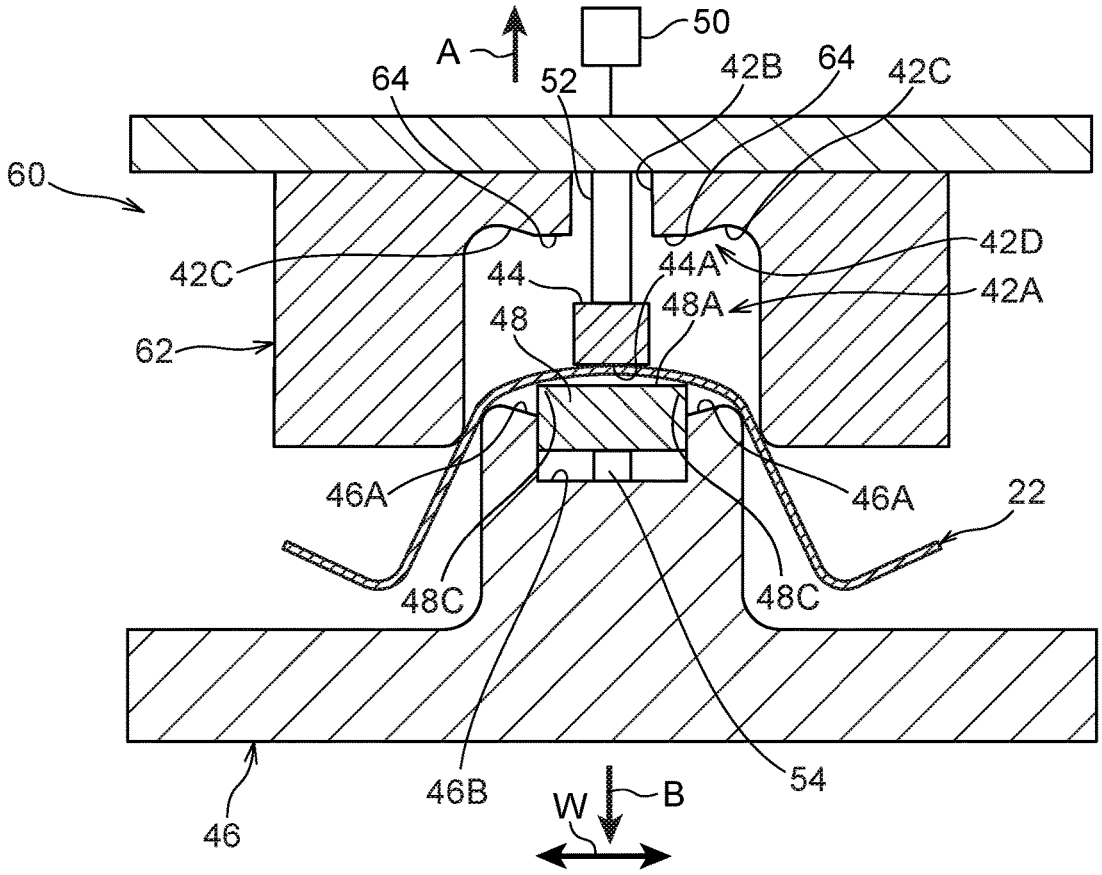
FIG. 13A is a cross-section in front view of a press apparatus, illustrating a state in a second process of a press-molded article manufacturing method according to the second exemplary embodiment.

Next, explanation follows regarding a press-molded article manufacturing method of a second exemplary embodiment, with reference to FIG. 12 to FIG. 14. In the second exemplary embodiment, the press-molded article 10 is molded using a press apparatus 60 that differs from the press apparatus 40 of the first exemplary embodiment. The press apparatus 60 employed in the second exemplary embodiment is similar in configuration to the press apparatus 40 of the first exemplary embodiment with the exception of a die 62 and a die pad 44 housed in the die 62. This will be described in detail below. Note that portions of the press apparatus 60 configured similarly to those of the press apparatus 40 are allocated the same reference numerals.

Namely, the difference to the first exemplary embodiment lies in the fact that in the die 62 and the die pad 44 of the press apparatus 60, a width dimension DPH of the die pad 44 is smaller than in the first exemplary embodiment, and a width dimension DSH of the pad housing portion 42B of the die 62 that houses the die pad 44 is also smaller than in the first exemplary embodiment.

Moreover, the bottom face (an opposing face opposing the apex portion 46C of the punch 46) of the recess (die cavity) 42A of the die 62 is formed with a pair of top plate-molding faces 64 between the inclined faces 42C and the pad housing portion 42B. The top plate-molding faces 64 extend from width direction inside ends of the inclined faces 42C toward the width direction central side of the die 62. Moreover, the top plate-molding faces 64 are disposed opposing the inner pad 48 in the apparatus up-down direction, and are parallel to the upper face 48A of the inner pad 48.

In the second exemplary embodiment too, the press-molded article 10 is molded by going through a first process to a third process similar to those of the first exemplary embodiment. Namely, as illustrated in FIG. 12, in the first process, the back face of the intermediate molded article 22 is set on the upper face 48A of the inner pad 48 in a state in which the inner pad 48 projects from the pad housing portion 46B toward the apparatus upper side. The pad pressing device 52 is then used to move the die pad 44 from the pad housing portion 42B toward the apparatus lower side, and the die pad 44 is retained in a state separated from the inner pad 48 by the predetermined distance H1.

In the second process, from the state illustrated in FIG. 12, the die 62 is moved by the moving device 50 relative to the die pad 44, the inner pad 48, and the punch 46 toward the apparatus lower side, this being the punch 46 side, while maintaining the relative positional relationship between the die pad 44 and the inner pad 48 in the apparatus up-down direction. The punch 46 is thus pushed inside the recess (die cavity) 42A of the die 62, molding the portions of the intermediate molded article 22 corresponding to the side walls 10C (see FIG. 13A).

Figure 13B:
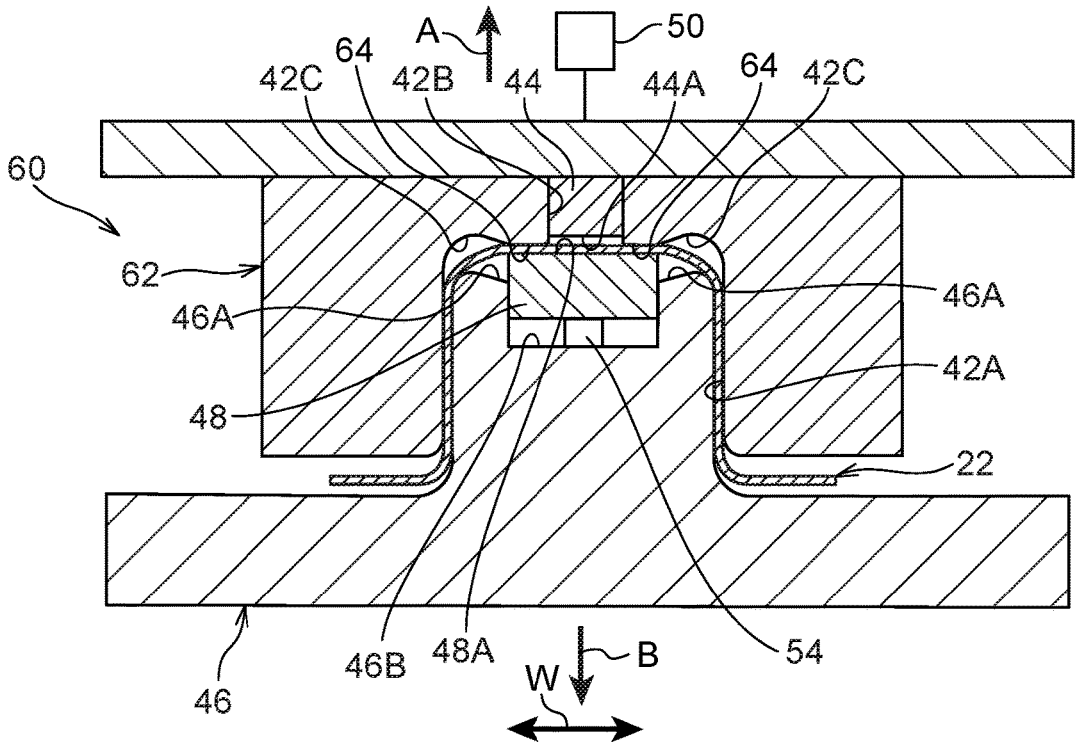
FIG. 13B is a cross-section in front view of a press apparatus, illustrating a state in which a die has moved relatively toward a punch side from the state illustrated in FIG. 13A, and the die and a die pad have been integrated together.

Next, the moving device 50 moves the die 62 further toward the apparatus lower side relative to the die pad 44, the inner pad 48, and the punch 46, and integrates the die 62 and the die pad 44 together. Namely, as illustrated in FIG. 13B, the die pad 44 is housed inside the pad housing portion 42B. Then, in the second exemplary embodiment, in the latter part of the second process, when the die 62 and the die pad 44 have been integrated together, the intermediate molded article 22 is pressed and held by the top plate-molding faces 64 of the die 62 and the inner pad 48.

In the third process, the die 62 and the die pad 44 that have been integrated together are moved by the moving device 50 further toward the apparatus lower side so as to be pushed in toward the punch 46 side. When this is performed, the relative positional relationship between the die pad 44 and the inner pad 48 in the apparatus up-down direction, and the pressing and holding of the top plate 20A by the top plate-molding faces 64 of the die 62 and the inner pad 48, are maintained by the pad pressing devices 52, 54. While maintaining this state, the inner pad 48 is then moved toward the apparatus lower side together with the die 62 and the die pad 44, so as to be housed inside the pad housing portion 46B (see FIG. 14A). Namely, the inner pad 48 is housed inside the pad housing portion 46B such that the portion of the intermediate molded article 22 corresponding to the top plate 10A of the press-molded article 10 is flattened.

Figure 14A:
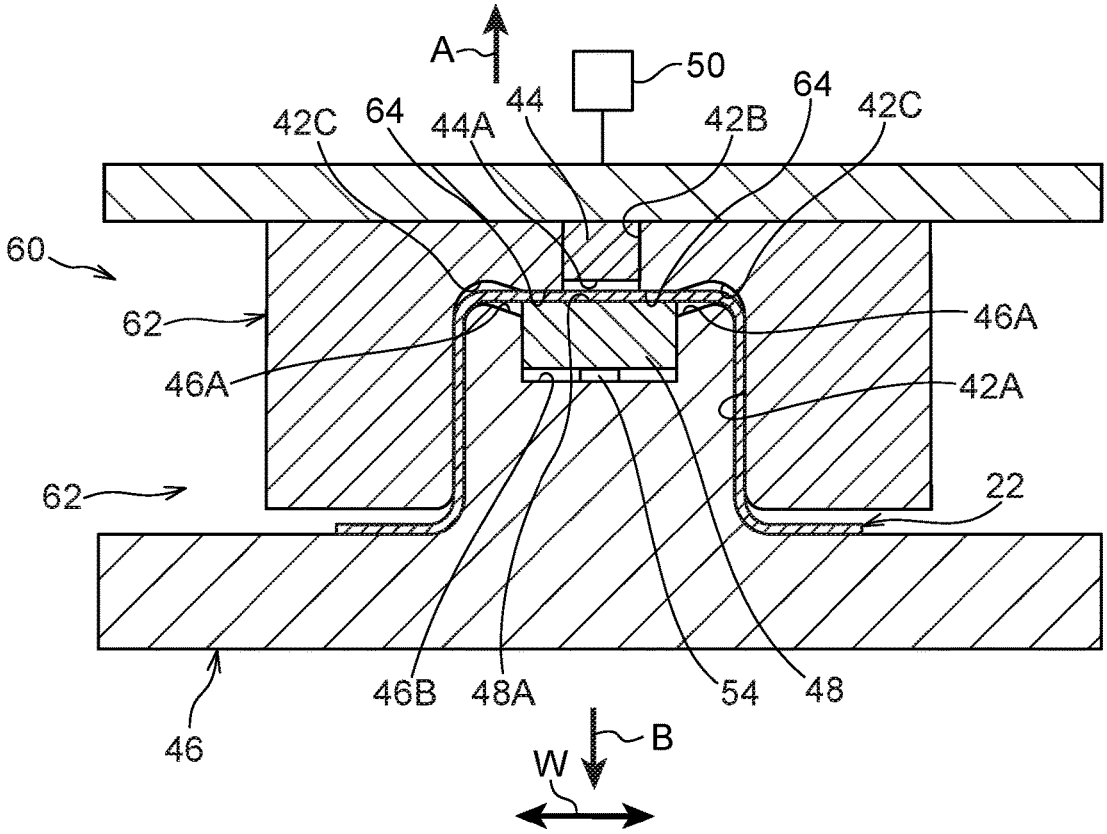
FIG. 14A is a cross-section in front view of a press apparatus, illustrating a state in which the die and the die pad have moved further relatively toward the punch side from the state illustrated in FIG. 13B.
Figure 14B:
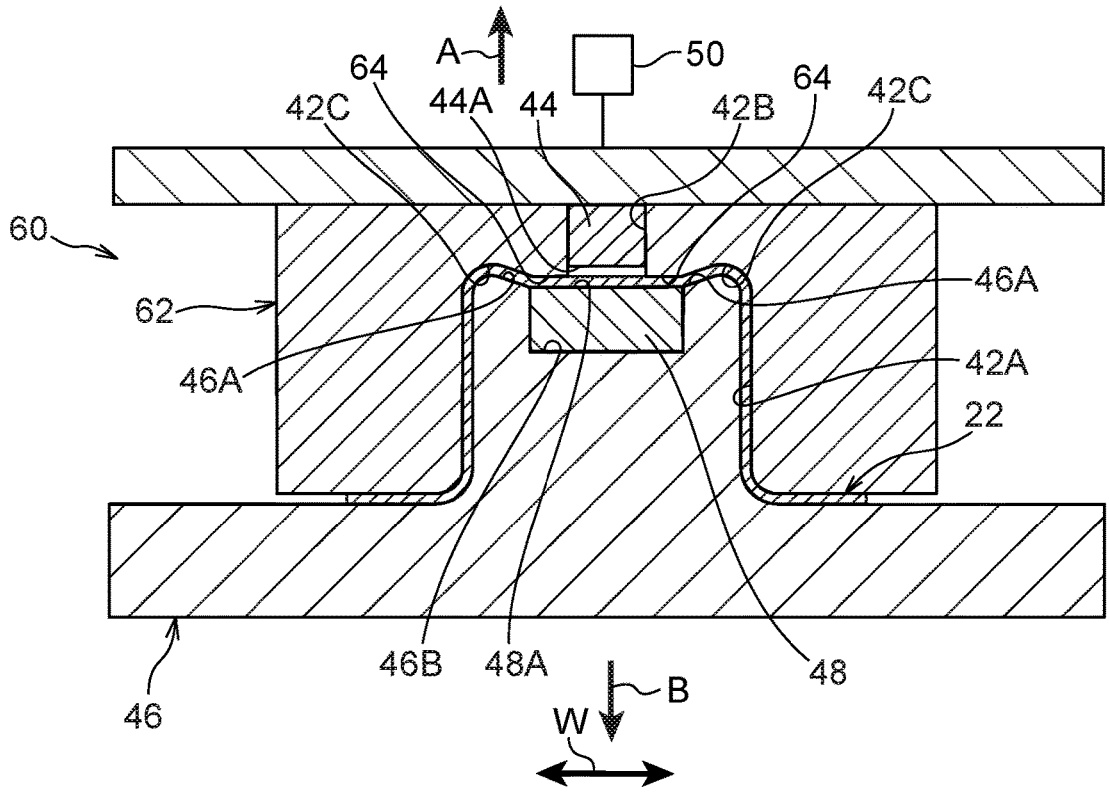
FIG. 14B is a cross-section in front view of a press apparatus, illustrating a state in which the die and the die pad have reached bottom dead center from the state illustrated in FIG. 14A.

Moreover, from the state illustrated in FIG. 14A, the die 62 and the die pad 44 that have been integrated together are moved further toward the apparatus lower side by the moving device 50 so as to be pushed in toward the punch 46 side. The intermediate molded article 22 is thereby pressed and held by the die 62 and the punch 46 (see FIG. 14B), such that the portion of the intermediate molded article 22 corresponding to the top plate 10A is warped so as to be convex toward the back face side of the intermediate molded article 22 (the inside of the press-molded article 10). As a result, after demolding the top plate 10A of the press-molded article 10 adopts a flat plane shape. Due to the above, the second exemplary embodiment is also capable of suppressing the second moment from arising in the press-molded article 10, thereby enabling similar operation and advantageous effects to those of the first exemplary embodiment to be exhibited.

Moreover, in the second exemplary embodiment, in the latter part of the second process, when the die 62 and the die pad 44 have been integrated together, the intermediate molded article 22 can be pressed and held by the top plate-molding faces 64 of the die 62 and the inner pad 48. This thereby enables a contribution to be made to flattening the top plate 10A of the press-molded article 10 after molding.

Note that in the first exemplary embodiment and the second exemplary embodiment, the press-molded article 10 is formed with a hat-shaped cross-section profile. However, the press-molded article 10 may be formed with a U-shaped cross-section profile (gutter profile) opening toward the lower side. Namely, the press-molded article manufacturing methods of the first exemplary embodiment and the second exemplary embodiment may be applied even to embodiments in which the pair of ridge line portions 10D and the flanges 10E are omitted from the press-molded article 10. Moreover, in such cases, the metal sheet blank 20 is pressed straight away by the press apparatus 40, 60 without pre-processing the metal sheet blank 20. Moreover, the press-molded article manufacturing methods of the first exemplary embodiment and the second exemplary embodiment may also be applied even in embodiments in which one of the ridge line portions 10D and the flanges 10E of the press-molded article 10 are omitted.

Moreover, although in the first exemplary embodiment and the second exemplary embodiment, the top plate 10A and the side walls 10C of the press-molded article 10 are formed in flat plate shapes, the top plate 10A and the side walls 10C of the press-molded article 10 may be formed with stepped profiles or the like. Moreover, the press-molded article 10 may be slightly curved such that in plan view a length direction intermediate portion of the press-molded article 10 is convex toward one side or the other side in the width direction. Moreover, the press-molded article 10 may be slightly curved such that in side view a length direction intermediate portion of the press-molded article 10 is convex toward the upper side or the lower side.

Moreover, from the perspective of suppressing generation of the second moment as described above, it is desirable for the predetermined distance H1 to be set in the press-molded article 10 so as to flex the first flexing portion 24A of the flexing portion 24 of the intermediate molded article 22 within its resilient range. However, as described above, the first flexing portion 24A of the flexing portion 24 may be flexed within a plastic range lying inside a range of positional error for the die pad 44, the inner pad 48, and the like in the apparatus up-down direction. In such cases, the flexing portion 24 can be bent back toward the inside of the press-molded article 10 in the third process described above.

This also enables the top plate 10A of the press-molded article 10 to be made so as to be flat after demolding. Moreover, the degree of flatness and the like of the top plate 10A of the press-molded article 10 after demolding can be kept within a tolerance and generation of the second moment can be effectively suppressed. In such cases, the lower face 44A of the die pad 44 may be provided with a convex profile projecting toward the inner pad 48 side (the apparatus lower side), and the upper face 48A of the inner pad 48 may be formed with a concave profile that is open toward the die pad 44 side (the apparatus upper side) and corresponds to this convex profile.

Moreover, although in the first exemplary embodiment and the second exemplary embodiment, the pair of inclined faces 42C are formed to the die 42 (62), and the pair of inclined faces 46A are formed to the apex portion 46C of the punch 46, the inclined faces 42C and the inclined faces 46A may be omitted. Namely, the bottom face of the recess 42A of the die 42 (62) may be configured with a flat profile, and the face of the apex portion 46C of the punch 46 may be configured with a flat profile that is not indented.

Moreover, in the first exemplary embodiment and the second exemplary embodiment, when the die pad 44 and the die 42 (62) have been integrated together (namely, in the latter part of the second process), the lower face 44A of the die pad 44 is housed inside the pad housing portion 42B. Alternatively, when the die pad 44 and the die 42 (62) have been integrated together (namely, in the latter part of the second process), the lower face 44A of the die pad 44 may lie in the same plane as the opening face of the pad housing portion 42B. Namely, configuration may be made such that the up-down dimension of the die pad 44 is less than or equal to the up-down dimension of the pad housing portion 42B.

In cases in which the die pad 44 and the pad housing portion 42B have the same up-down dimension as each other, with respect to the first exemplary embodiment, in the latter part of the second process, the bottom face of the pad housing portion 42B of the die 42 and the upper face of the die pad 44 are placed in contact with each other (caused to bottom out). In cases in which the up-down dimension of the die pad 44 is smaller than the up-down dimension of the pad housing portion 42B, the controller 56 controls the pad pressing device 52 so as to place the lower face 44A of the die pad 44 in the same plane as the opening face of the pad housing portion 42B.

Figure 15:
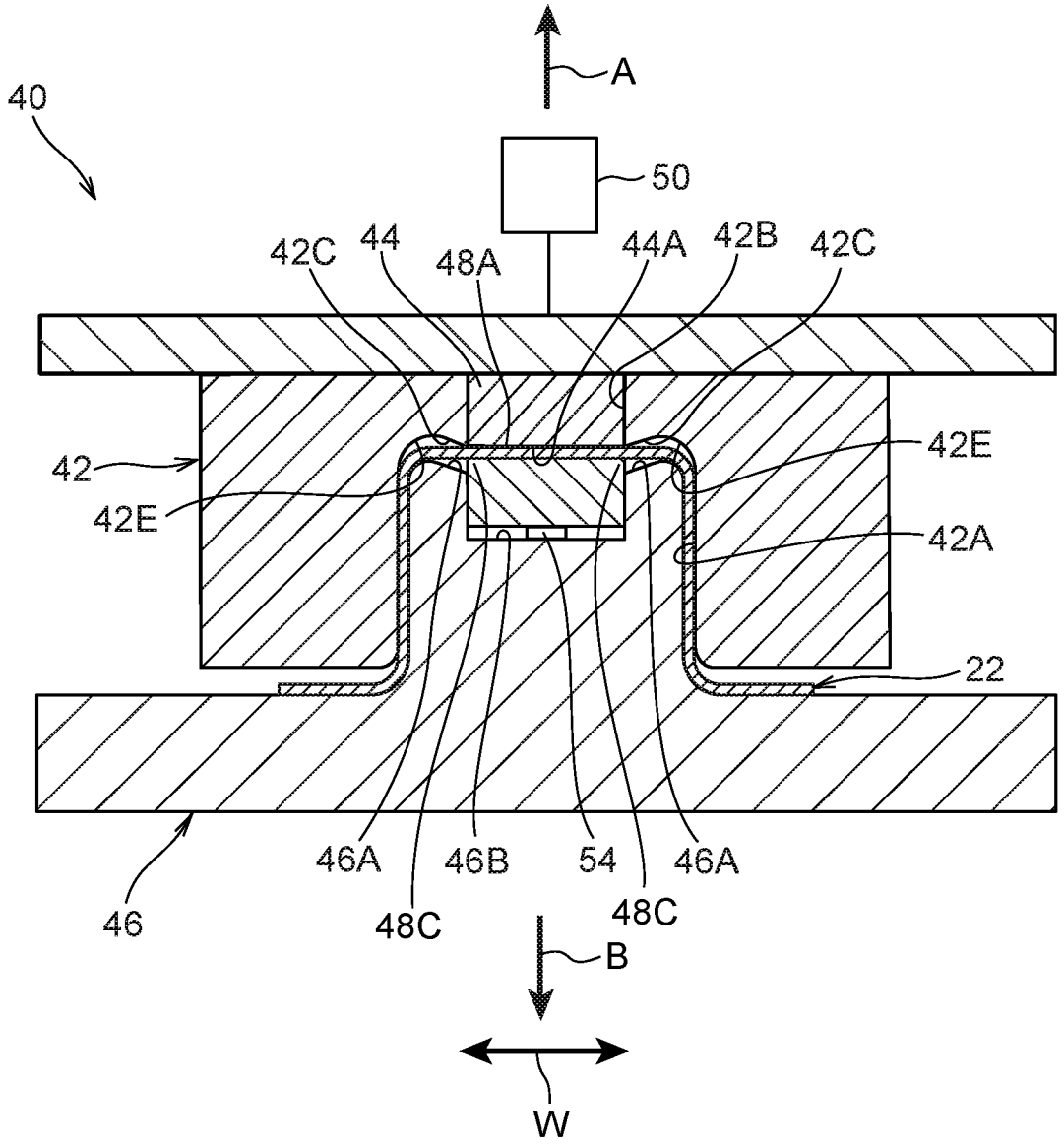
FIG. 15 is a cross-section in front view illustrating one example of a modified example of the press apparatus illustrated in FIG. 1A.

Then in the third process, the die 42 and the die pad 44 that have been integrated together (whose relative positions are fixed) may be moved by the moving device 50 toward the apparatus lower side, such that the intermediate molded article 22 is pressed and held by the inner pad 48 and the die pad 44. Then, as illustrated in FIG. 15, in the latter part of the third process, in a state in which in which the intermediate molded article 22 is pressed and held by the inner pad 48 and the die pad 44, the inner pad 48 is moved together with the die 42 and the die pad 44 toward the apparatus lower side relative to the punch 46. Namely, the die 42 and the die pad 44, and the inner pad 48 are moved toward the apparatus lower side from the state illustrated in FIG. 15. The entire portion of the intermediate molded article 22 corresponding to the top plate 10A can thereby be pressed and held by the die 42 and the die pad 44, and the punch 46 and the inner pad 48, enabling even better flattening of the top plate 10A.

Moreover, in the first exemplary embodiment and the second exemplary embodiment, the controller 56 actuates the pad pressing devices 52, 54 such that the die pad 44 is maintained in a state separated from the inner pad 48 by the predetermined distance H1 from the first process until completion of the third process. Alternatively, the pad pressing device 52 may be actuated by the controller 56 in the latter part of the third process so as to move the die pad 44 toward the apparatus lower side such that the intermediate molded article 22 is pressed and held by the inner pad 48 and the die pad 44. In such cases, in the latter part of the third process, the entire portion of the intermediate molded article 22 corresponding to the top plate 10A can be pressed and held by the die 42 and the die pad 44, and the punch 46 and the inner pad 48, enabling even better flattening of the top plate 10A.

Moreover, in the first exemplary embodiment and the second exemplary embodiment, the controller 56 actuates the pad pressing devices 52, 54 so as to maintain the die pad 44 in a state separated from the inner pad 48 by the predetermined distance H1 from the first process until completion of the third process. Alternatively, either the die pad 44 or the inner pad 48 may be provided with a stopper for maintaining a separated state of the die pad 44 with respect to the inner pad 48.

Figure 3B:
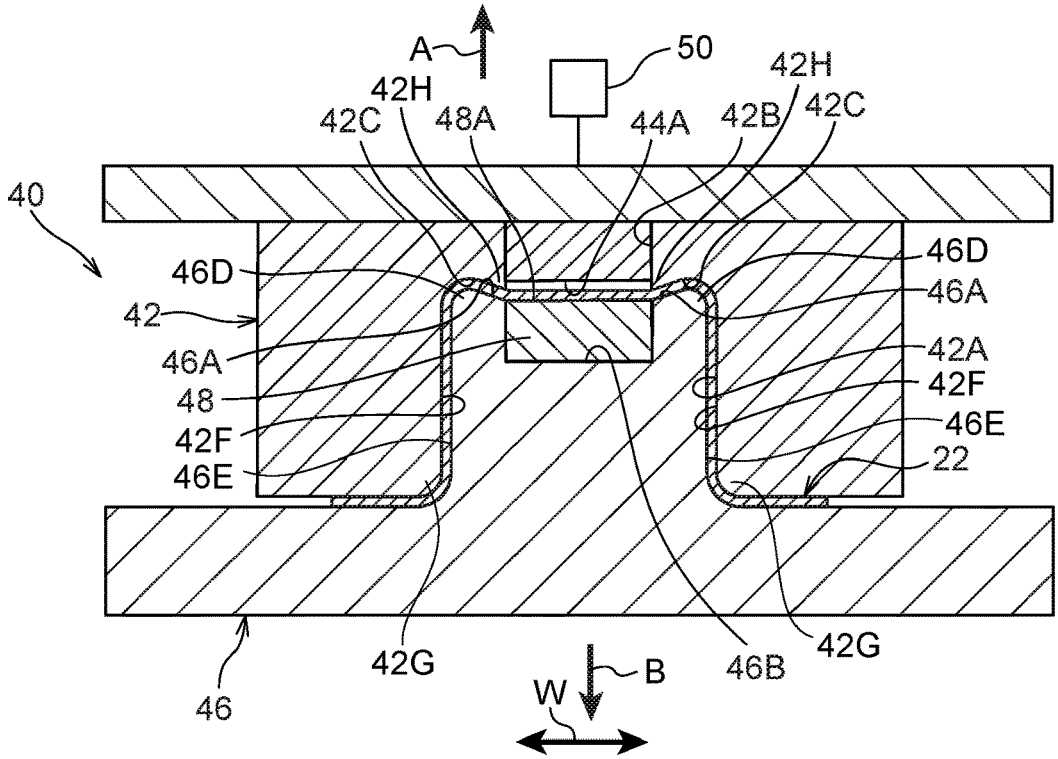
FIG. 3B is a cross-section in front view of a press apparatus, illustrating a state in which the die and the die pad have reached bottom dead center from the state illustrated in FIG. 3A.
Figure 16:
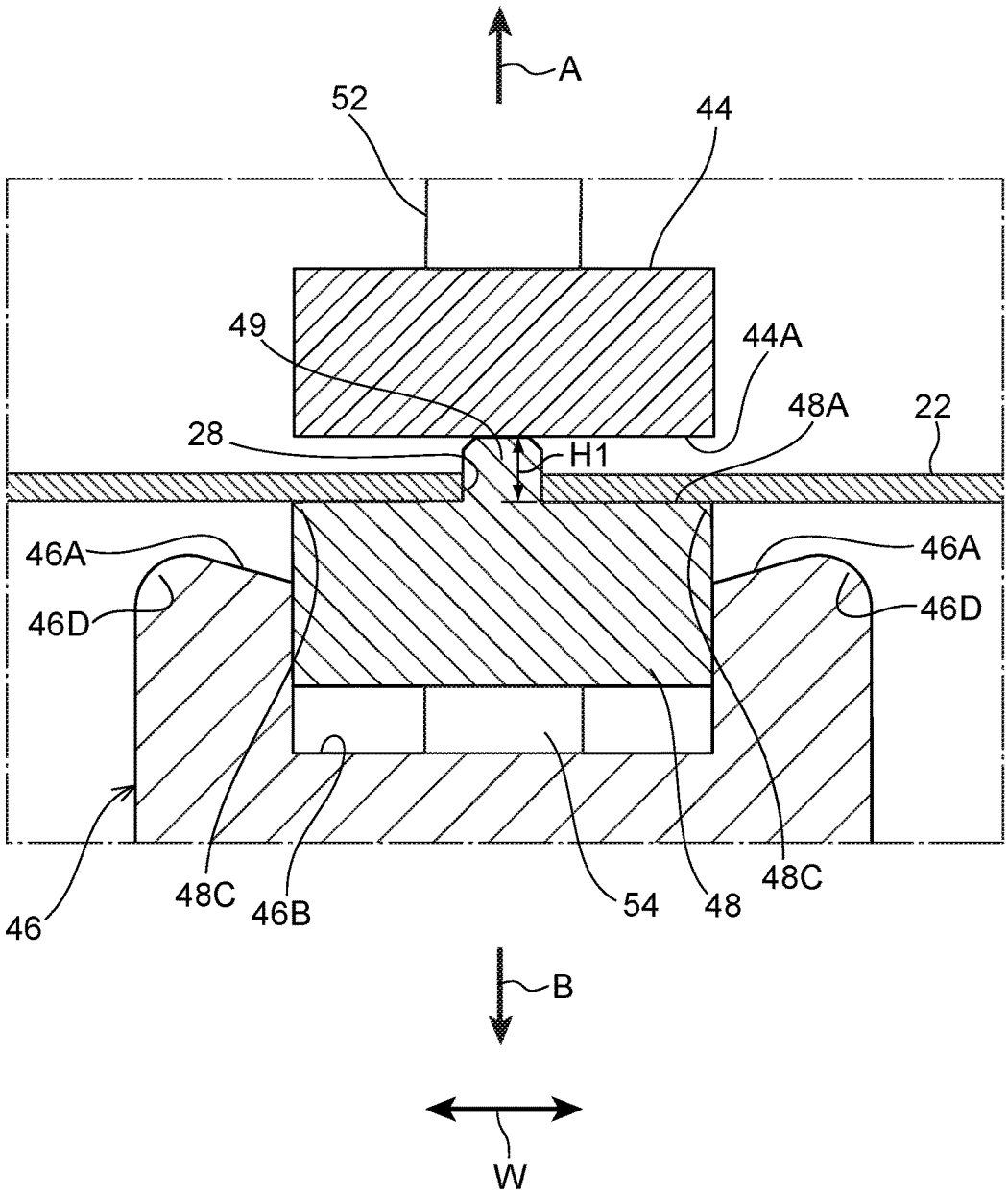
FIG. 16 is an enlarged cross-section illustrating an example in which a stopper has been additionally provided to the press apparatus illustrated in FIG. 1A.

For example, as illustrated in FIG. 16, a stopper 49 is provided so as to project in the pressing direction from the upper face 48A of the inner pad 48. In such cases, a hole 28 through which the stopper 49 is able to pass is formed in the intermediate molded article 22 or the metal sheet blank 20. The projection height of the stopper 49 from the upper face 48A of the inner pad 48 is set to the predetermined distance H1. As illustrated in FIG. 3B, for example, the predetermined distance H1 is set so as to be greater than a clearance between the punch wall faces 46E and the die cavity wall faces 42F in a state in which the die 42 has reached the molding bottom dead center, and the relative position of the die 42 and the punch 46 has reached the molding bottom dead center.

This thereby enables the die pad 44 to be maintained in a state separated from together inner pad 48 by the predetermined distance H1 due to the lower face 44A of the die pad 44 abutting the leading end portion of the stopper 49. Moreover, the predetermined distance H1 between the die pad 44 and the inner pad 48 can be maintained mechanically from the first process until completion of the third process. Note that in addition to hydraulic devices, electrically powered devices, and the like, the pad pressing devices 52, 54 may also be configured by springs, gas cushions, or the like.

Moreover, in the example illustrated in FIG. 16, the stopper 49 is provided so as to be incapable of relative movement with respect to one of the die pad 44 or the inner pad 48. However, the stopper 49 may be provided so as to be capable of relative movement with respect to the one of the die pad 44 or the inner pad 48. Explanation follows regarding this point, for an example in which the press apparatus 40 illustrated in FIG. 15 is employed, and a stopper 49 capable of relative movement with respect to the inner pad 48 is provided.

Figure 17:
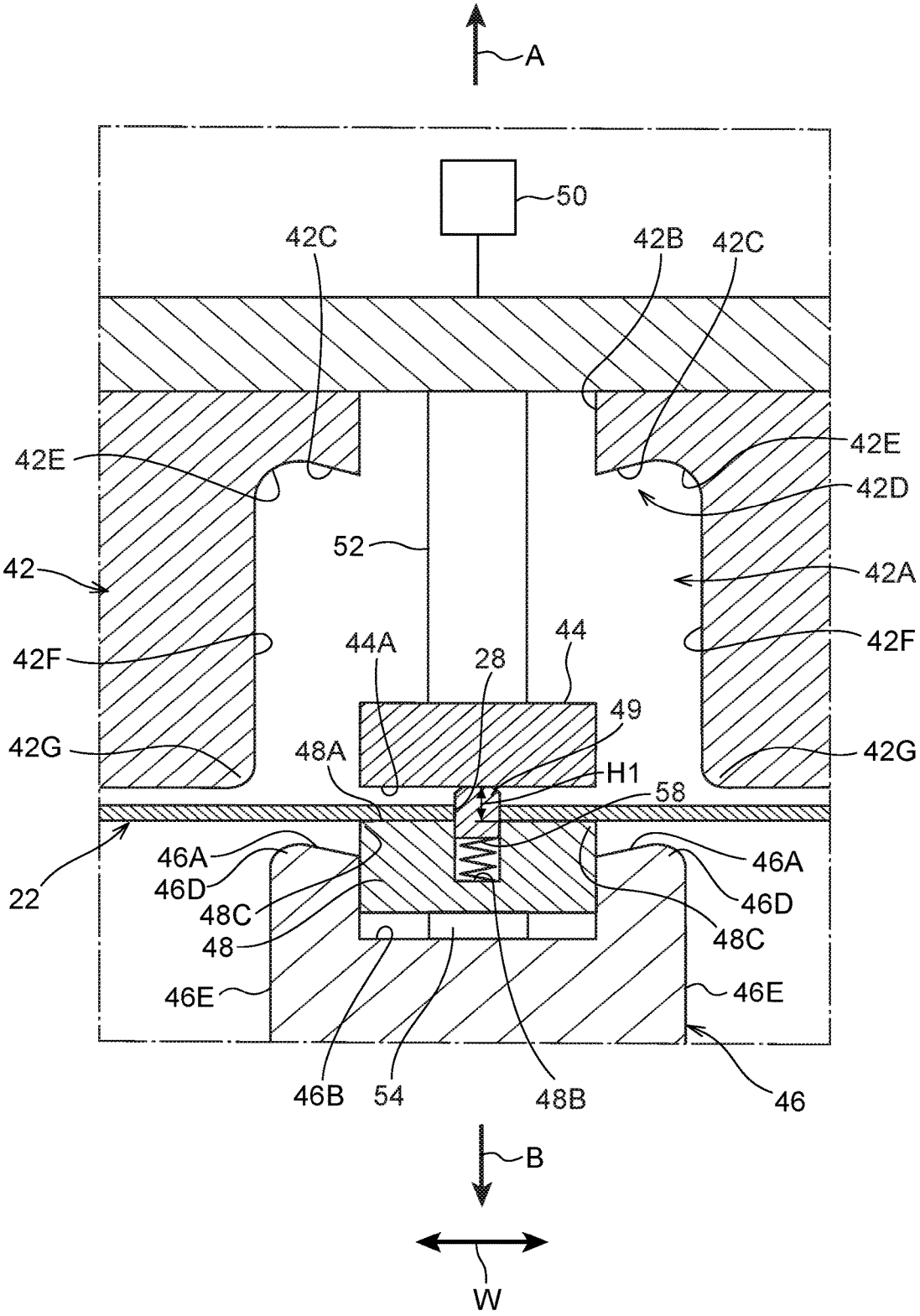
FIG. 17 is a cross-section in front view illustrating a press apparatus in which the stopper illustrated in FIG. 16 is movable relative to an inner pad.

In this example, as illustrated in FIG. 17, a housing recess 48B that houses the stopper 49 is formed on the upper face 48A of the inner pad 48. The stopper 49 is housed inside the housing recess 48B so as to be movable in the apparatus up-down direction. A biasing mechanism 58, serving as an example of an extension-retraction mechanism that extends and retracts in the pressing direction is provided between the bottom face of the housing recess 48B and the stopper 49. The biasing mechanism 58 may, for example, be configured by a spring, a hydraulic cylinder, or the like.

The biasing mechanism 58 applies the stopper 49 with biasing force toward the apparatus upper side. The stopper 49 is projected out in the pressing direction from the upper face 48A of the inner pad 48 by the biasing force of the biasing mechanism 58. As illustrated in FIG. 17, the position of the stopper 49 in a state in which the stopper 49 is projecting from the upper face 48A of the inner pad 48 is an initial position.

Note that although omitted from the drawings, a restriction portion is formed to the inner pad 48 to restrict movement of the stopper 49 toward the apparatus upper side with respect to the inner pad 48 in the initial position. Moreover, when in the initial position, a biasing force toward the apparatus upper side from the biasing mechanism 58 acts on the stopper 49 such that the projection height of the stopper 49 from the upper face 48A of the inner pad 48 is the predetermined distance H1.

Moreover, the following relationship (Equation 1) is satisfied between actuation force of the moving device 50 (F1), pressing direction biasing force of the biasing mechanism 58, serving as an example of an extension-retraction mechanism (retention force: F2), pressing force of the inner pad 48 due to the pad pressing device 54 (retention force: F3), and a pressing force of the die pad 44 due to the pad pressing device 52 (retention force: F4):

$$F1>F2>F3>F4 \quad \text{(Equation 1)}$$

The hole 28 through which the stopper 49 passes is formed in the intermediate molded article 22 or in the metal sheet blank 20.

Moreover, as illustrated in FIG. 17, in the first process, the intermediate molded article 22 is set on the upper face 48A of the inner pad 48 by passing the stopper 49 inside the hole 28 in the intermediate molded article 22. The controller 56 then actuates the pad pressing device 52 to move the die pad 44 toward the apparatus lower side from the pad housing portion 42B and to abut the die pad 44 against the leading end portion of the stopper 49. When this is performed, due to the relationship of Equation 1, the inner pad 48 can be maintained in a state projecting from the punch 46 toward the apparatus upper side by the pressing force of the pad pressing device 54. The die pad 44 is separated to the apparatus upper side of the inner pad 48 by the predetermined distance H1 due to the biasing force of the biasing mechanism 58.

Although omitted from the drawings, in the second process, the moving device 50 moves the die 42 toward the apparatus lower side. When this is performed, the stopper 49 is maintained in the initial position by the biasing force of the biasing mechanism 58. Namely, the die 42 and the die pad 44 are integrated together while the die pad 44 is still being maintained in a state separated from the inner pad 48 by the predetermined distance H1. Note that in the second process, when the moving device 50 moves the die 42 toward the apparatus lower side, the intermediate molded article 22 is bent so as to form the side walls 10C. When this is performed, although the actuation force of the moving device 50 is greater than the pressing force on the inner pad 48 from the pad pressing device 54, the projected state of the inner pad 48 from the punch 46 can be maintained.

Moreover, in the third process, the die 42 and the die pad 44 that have been integrated together are moved further toward the apparatus lower side by the moving device 50, and the inner pad 48 is housed inside the pad housing portion 46B. When this is performed, due to above Equation 1 being satisfied, the inner pad 48 moves together with the die 42 and the die pad 44 toward the apparatus lower side, while the stopper 49 is still maintained at the initial position. In other words, the inner pad 48 is moved together with the die 42 and the die pad 44 toward the apparatus lower side, while the predetermined distance H1 between the die pad 44 and the inner pad 48 is still being maintained by the stopper 49, so as to thereby house the entire inner pad 48 inside the pad housing portion 46B.

In a latter of the third process, the die 42 and the die pad 44 that have been integrated together are then moved further toward the apparatus lower side by the moving device 50 so as to reach the bottom dead center. When this is performed, due to above Equation 1 being satisfied, the stopper 49 moves toward the apparatus lower side with respect to the inner pad 48 against the biasing force of the biasing mechanism 58. Namely, the stopper 49 moves toward the apparatus lower side with respect to the inner pad 48, and the die 42 and the die pad 44 that have been integrated together also move toward the apparatus lower side with respect to the inner pad 48.

Figure 18:
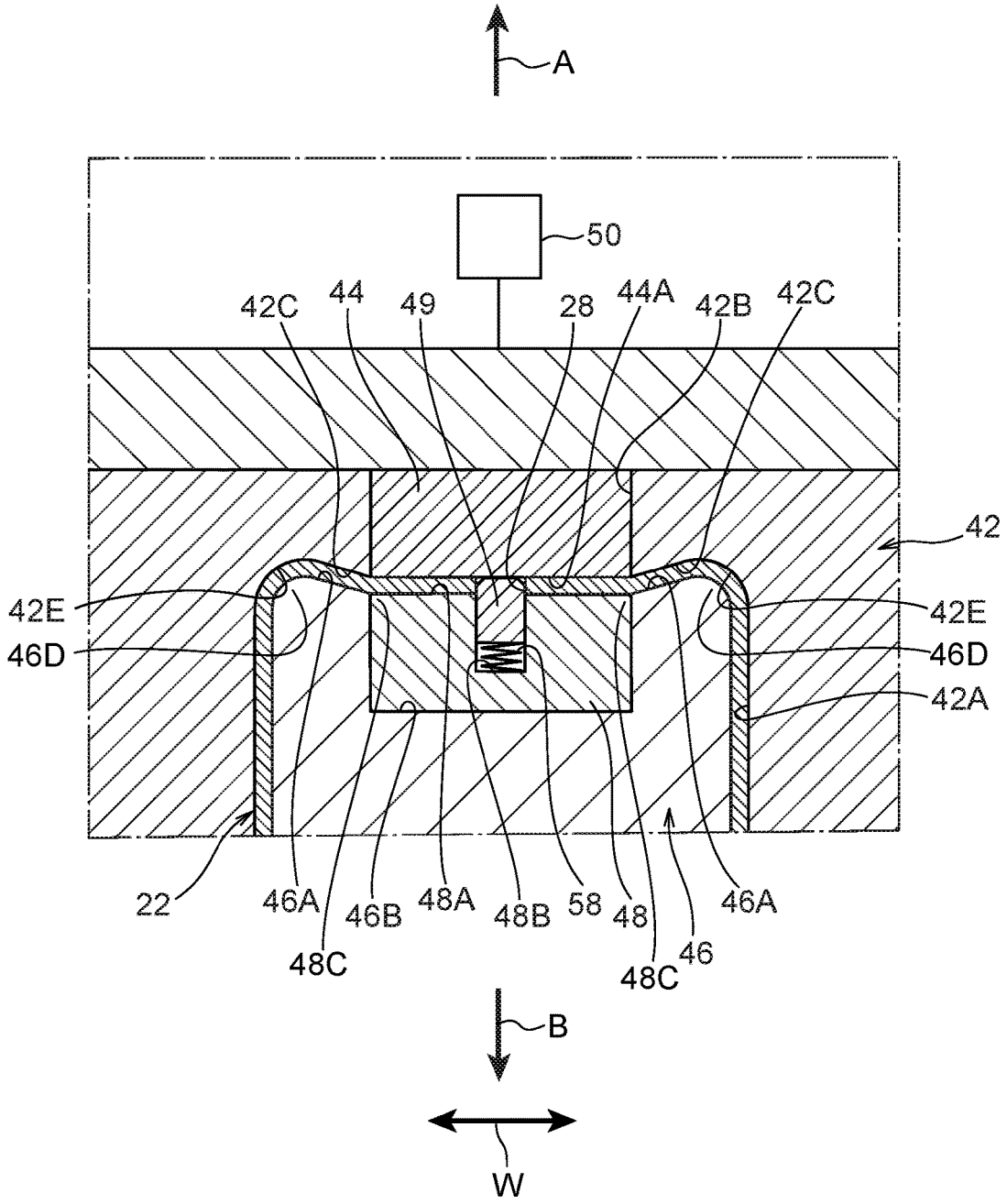
FIG. 18 is a cross-section illustrating the press apparatus illustrated in FIG. 17 in a state in which a die and a die pad have reached bottom dead center.

Then, as illustrated in FIG. 18, at the point in time when the die 42 and the die pad 44 have reached the bottom dead center, the majority (all except the leading end portion) of the stopper 49 is housed inside the housing recess 48B. In this manner, by providing the stopper 49 movable relative to the inner pad 48, the entire portion of the intermediate molded article 22 corresponding to the top plate 10A can be pressed and held by the die 42 and the die pad 44, and the punch 46 and the inner pad 48. Similarly to in the example illustrated in FIG. 15, this thereby enables even better flattening of the top plate 10A.

Note that instead of Equation 1 described above, the relationship of the following Equation 2 may be set for an actuation force of the moving device 50 (F11), a pressing force of the inner pad 48 due to the pad pressing device 54 (retention force: F12), a biasing force of the biasing mechanism 58, serving as an example of an extension-retraction mechanism (F13), and a pressing force of the die pad 44 due to the pad pressing device 52 (retention force: F14):

$$F11>F12>F13>F14 \qquad \text{Equation 2}$$

In such cases, although omitted from the drawings, in the third process, when the die 42 and the die pad 44 that have been integrated together are moved by the moving device 50 toward the apparatus lower side, due to the relationship in above Equation 2 being satisfied, the stopper 49 moves from the initial position toward the apparatus lower side with respect to the inner pad 48 against the biasing force of the biasing mechanism 58. Namely, the stopper 49 moves toward the apparatus lower side with respect to the inner pad 48, and the die 42 and the die pad 44 that have been integrated together also move toward the apparatus lower side with respect to the inner pad 48. The intermediate molded article 22 is thus pressed and held by the die pad 44 and the inner pad 48.

Then, when the die 42 and the die pad 44 are moved from this state by the moving device 50 toward the apparatus lower side, due to above Equation 2 being satisfied, the inner pad 48 moves together with the die 42 and the die pad 44 toward the apparatus lower side. In other words, the inner pad 48 moves together with the die 42 and the die pad 44 toward the apparatus lower side, while the intermediate molded article 22 is still pressed and held by the die pad 44 and the inner pad 48. Then, in the latter part of the third process, the entire inner pad 48 is housed inside the pad housing portion 46B. This thereby enables the entire portion of the intermediate molded article 22 corresponding to the top plate 10A to be pressed and held by the die 42 and the die pad 44, and the punch 46 and the inner pad 48. Accordingly, such cases also enables even better flattening of the top plate 10A, similarly to the example illustrated in FIG. 15.

Although in the example illustrated in FIG. 16 and FIG. 17 the stopper 49 is provided to the upper face 48A of the inner pad 48, the position of the stopper 49 may be modified as appropriate. For example, with respect to the press-molded article 10, the stopper 49 may be set so as to be disposed at the outside in the length direction of the press-molded article 10.

Moreover, a stopper 49 that is also utilized as a pin to position the intermediate molded article 22 with respect to the inner pad 48 may be provided so as to provide the stopper 49 on the upper face 48A of the inner pad 48, as in the example illustrated in FIG. 16 and FIG. 17. This thereby enables positional misalignment with respect to the intermediate molded article 22 during molding to be prevented.

EXPLANATION OF THE REFERENCE NUMERALS FOLLOWS

10 press-molded article
10A top plate
10B ridge line
10C side wall
10D ridge line
10E flange
20 metal sheet blank
22 intermediate molded article
40 press apparatus
42 die
42C inclined face (die-side inclined face)
44 die pad
46 punch
46A inclined face (punch-side inclined face)
48 inner pad
49 stopper
50 moving device
52 pad pressing device (second coupling device)
54 pad pressing device (first coupling device)
56 controller
58 biasing mechanism
60 press apparatus
62 die Supplement The following aspects may be generalized from the present specification.

Namely, a method of manufacturing a press-molded article according to a first aspect is a method of manufacturing a press-molded article including side walls extending from a pair of ridge line portions positioned at both width direction sides of a top plate, toward one plate thickness direction side of the top plate. The press-molded article manufacturing method includes: a first process of projecting an inner pad, provided at an apex portion of a punch, from the punch toward a side of die and disposing a metal sheet blank on the inner pad, and projecting a die pad, provided at the die, from the die toward a side of the punch and disposing the die pad at a position separated from the inner pad by a predetermined distance that is greater than a plate thickness of the metal sheet blank; a second process of moving the die toward the punch side relative to the die pad, the inner pad, and the punch, forming the side walls using the die and the punch, and integrating the die pad with the die; and a third process of moving the die and the die pad, which have been integrated, and the inner pad, toward the punch side relative to the punch to form the top plate.

A press-molded article manufacturing method according to a second aspect is the first aspect, wherein a relative positional relationship between the inner pad and the die pad is maintained from the first process until completion of the third process.

A press-molded article manufacturing method according to a third aspect is the second aspect, wherein a stopper is provided at one of the inner pad or the die pad such that the stopper projects the predetermined distance toward a side of the other of the inner pad or the die pad.

A press-molded article manufacturing method according to a fourth aspect is the first aspect, wherein: in a latter part of the second process, the die pad and the die, which have been integrated, are moved toward the punch side relative to the punch, and the metal sheet blank is held by the inner pad and the die pad; and in the third process, the die and the die pad, and the inner pad, are moved toward the punch side relative to the punch in a state in which the metal sheet blank is held by the inner pad and the die pad.

A press-molded article manufacturing method according to a fifth aspect is the first aspect, wherein: a stopper is provided at one of the inner pad or the die pad such that the stopper projects the predetermined distance toward a side of the other of the inner pad or the die pad, and the stopper is configured to be relatively movable toward a side of the one of the inner pad or the die pad; a relative positional relationship between the inner pad and the die pad is maintained from the first process until in a latter part of the third process by the stopper abutting the other of the inner pad or the die pad; and in the latter part of the third process, the stopper is moved toward the side of the one of the inner pad or the die pad such that the die pad and the die, which have been integrated, move toward the punch side relative to the inner pad and the metal sheet blank is held by the die pad and the inner pad.

A press-molded article manufacturing method according to a sixth aspect is any one of the first to fifth aspects, wherein: a punch-side inclined face is formed at the apex portion of the punch so as to become increasingly indented on progression from a shoulder of the punch toward a width direction central side of the punch; a die-side inclined face that corresponds to the punch-side inclined face is formed at an opposing face of the die opposing the apex portion of the punch; and in the latter part of the third process, the metal sheet blank is held by the punch-side inclined face and the die-side inclined face.

A press apparatus according to a seventh aspect is a press apparatus that manufactures a metal sheet blank into a press-molded article including side walls extending from a pair of ridge line portions positioned at both width direction sides of a top plate, extend toward one plate thickness direction side of the top plate. The press apparatus includes: a punch that includes an inner pad at an apex portion of the punch; a die that includes a die pad disposed opposing the inner pad; a first coupling device that couples the inner pad to the punch so as to enable relative movement in a direction of opposition between the die and the punch; a second coupling device that couples the die pad to the die so as to enable relative movement in the direction of opposition between the die and the punch; and a controller that actuates the first coupling device and the second coupling device which the side walls are formed by the die and the punch, and maintains the die pad at a position separated from the inner pad by a predetermined distance that is greater than a plate thickness of the metal sheet blank.

A press apparatus according to an eighth aspect is a press apparatus manufactures a metal sheet blank into a press-molded article including side walls extending from a pair of ridge line portions positioned at both width direction sides of a top plate, extend toward one plate thickness direction side of the top plate. The press apparatus includes: a punch that includes an inner pad at an apex portion of the punch; a die that includes a die pad disposed opposing the inner pad; a first coupling device that couples the inner pad to the punch so as to enable relative movement in a direction of opposition between the die and the punch; a second coupling device that couples the die pad to the die so as to enable relative movement in the direction of opposition between the die and the punch; and a stopper that is provided at one of the inner pad or the die pad, and that projects a predetermined distance toward a side of the other of the inner pad or the die pad.

A press apparatus according to a ninth aspect is a press apparatus manufactures a metal sheet blank into a press-molded article including side walls extending from a pair of ridge line portions positioned at both width direction sides of a top plate, toward one plate thickness direction side of the top plate. The press apparatus includes: a punch that includes an inner pad at an apex portion of the punch; a die that includes a die pad disposed opposing the inner pad; a first coupling device that couples the inner pad to the punch so as to enable relative movement in a direction of opposition between the die and the punch; a second coupling device that couples the die pad to the die so as to enable relative movement in the direction of opposition between the die and the punch; a moving device that when actuated moves the die toward the punch side; a stopper that is provided to one of the inner pad or the die pad, that projects a predetermined distance toward a side of the other of the inner pad or the die pad, and that is configured to be relatively movable toward a side of the one of the inner pad or the die pad; and a biasing mechanism that applies a biasing force to the stopper toward the side of the other of the inner pad or the die pad in a state in which the stopper projects out toward the side of the other of the inner pad or the die pad. An actuation force of the moving device, the biasing force of the biasing mechanism, a retention force of the first coupling device, and a retention force of the second coupling device have a relationship that is either: the actuation force of the moving device>the biasing force of the biasing mechanism>the retention force of the first coupling device>the retention force of the second coupling device; or the actuation force of the moving device>the retention force of the first coupling device>the biasing force of the biasing mechanism>the retention force of the second coupling device.

A press apparatus according to a tenth aspect is any one of the seventh to ninth aspects, wherein: a punch-side inclined face is formed at the apex portion of the punch so as to become more indented on progression from a shoulder of the punch toward a width direction central side of the punch; and a die-side inclined face that corresponds to the punch-side inclined face is formed at an opposing face of the die opposing the apex portion of the punch.

A press apparatus according to an eleventh aspect is a press apparatus including: a punch that includes an apex portion intersecting a pressing direction, an inner pad housing portion formed at the apex portion, punch shoulders provided at both sides of the apex portion, and punch wall faces extending from the respective punch shoulders; an inner pad that includes an inner pad apex face intersecting the pressing direction, that is housed in the inner pad housing portion, and that is movable in the pressing direction; a first coupling device that couples the inner pad and the punch together, and that modifies a spacing in the pressing direction between the inner pad and the punch; a die that includes a die bottom opposing the apex portion, a die pad housing portion formed at the die bottom, bottom corners provided at both sides of the die bottom so as to correspond to the punch shoulders, and die cavity wall faces extending from each of the bottom corners so as to correspond to the punch wall faces; a die pad that includes an inner pad-opposing face opposing the inner pad apex face, that is housed in the die pad housing portion, and that is movable in the pressing direction; a second coupling device that couples the die pad and the die together, and that modifies a spacing in the pressing direction between the die pad and the die; and a controller that controls the first coupling device so as to modify the spacing between the inner pad and the punch, and that controls the second coupling device so as to modify the spacing between the die pad and the die.

A press apparatus according to a twelfth aspect is a press apparatus including: a punch that includes an apex portion intersecting a pressing direction, an inner pad housing portion formed at the apex portion, punch shoulders provided at both sides of the apex portion, and punch wall faces extending from the respective punch shoulders; an inner pad that includes an inner pad apex face intersecting the pressing direction, that is housed in the inner pad housing portion, and that is movable in the pressing direction; a first coupling device that couples the inner pad and the punch together, and that modifies a spacing in the pressing direction between the inner pad and the punch; a die that includes a die bottom opposing the apex portion, a die pad housing portion formed at the die bottom, bottom corners provided at both sides of the die bottom so as to correspond to the punch shoulders, and die cavity wall faces extending from each of the bottom corners so as to correspond to the punch wall faces; a die pad that includes an inner pad-opposing face opposing the inner pad apex face, that is housed in the die pad housing portion, and that is movable in the pressing direction; a second coupling device that couples the die pad and the die together, and that modifies a spacing in the pressing direction between the die pad and the die; and a stopper that is provided at one of the inner pad apex face or the inner pad-opposing face, and that projects in the pressing direction.

A press apparatus according to a thirteenth aspect is a press apparatus including: a punch that includes an apex portion intersecting a pressing direction, an inner pad housing portion formed at the apex portion, punch shoulders provided at both sides of the apex portion, and punch wall faces extending from the respective punch shoulders; an inner pad that includes an inner pad apex face intersecting the pressing direction, that is housed in the inner pad housing portion, and that is movable in the pressing direction; a first coupling device that couples the inner pad and the punch together, and that modifies a spacing in the pressing direction between the inner pad and the punch; a die that includes a die bottom opposing the apex portion, a die pad housing portion formed at the die bottom, bottom corners provided at both sides of the die bottom so as to correspond to the punch shoulders, and die cavity wall faces extending from each of the bottom corners so as to correspond to the punch wall faces; a die pad that includes an inner pad-opposing face opposing the inner pad apex face, that is housed in the die pad housing portion, and that is movable in the pressing direction; a second coupling device that couples the die pad and the die together, and that modifies a spacing in the pressing direction between the die pad and the die; a moving device that moves the die relatively toward the punch side; and a stopper projecting in the pressing direction that is provided at one of the inner pad apex face or the inner pad-opposing face via an extension-retraction mechanism that extends and retracts in the pressing direction. An actuation force of the moving device, a retention force in the pressing direction of the extension-retraction mechanism, a retention force of the first coupling device, and a retention force of the second coupling device have a relationship that is either: the actuation force of the moving device>the retention force in the pressing direction of the extension-retraction mechanism>the retention force of the first coupling device>the retention force of the second coupling device; or the actuation force of the moving device>the retention force of the first coupling device>the retention force in the pressing direction of the extension-retraction mechanism>the retention force of the second coupling device.

A press apparatus according to a fourteenth aspect is either the twelfth or thirteenth aspect, wherein a projection height of the stopper in the pressing direction is greater than a clearance between the punch wall faces and the die cavity wall faces when the die and the punch are at a molding bottom dead center.

A press apparatus according to a fifteenth aspect is any one of the eleventh to the fourteenth aspects, further comprising punch-side inclined faces provided at the apex portion of the punch so as to become more indented on progression from each of the punch shoulders toward the inner pad housing portion.

A press apparatus according to a sixteenth aspect is any one of the eleventh to the fifteenth aspects, further comprising die-side inclined faces provided at the die bottom of the die so as to project further on progression from each of the bottom corners toward the die pad housing portion.

A press apparatus according to a seventeenth aspect is any one of the eleventh to the sixteenth aspects, wherein the bottom corners have a shape having an inverted profile to that of the punch shoulders.

The entire disclosure of Japanese Patent Application No. 2016-009530 filed Jan. 21, 2016 is incorporated in the present specific by reference thereto.

All publications, patent applications and technical standards mentioned in the present specification are incorporated by reference in the present specification to the same extent as if the individual publication, patent application, or technical standard was specifically and individually indicated to be incorporated by reference.

The invention claimed is:

1. A method of manufacturing a press-molded article including side walls extending away from a pair of ridge line portions positioned at both width direction sides of a top plate, the method comprising:

projecting an inner pad, provided at an apex portion of a punch, from the punch toward a side of a die;

disposing a metal sheet blank on the inner pad;

projecting a die pad, provided at the die, from the die toward a side of the punch to dispose the die pad at a position separated from the inner pad by a predetermined distance that is greater than a plate thickness of the metal sheet blank;

forming the side walls by moving the die toward the punch side relative to the die pad, the inner pad, and the punch, and integrating the die pad with the die; and forming the top plate by moving the die and the die pad, which have been integrated, and the inner pad, toward the punch side relative to the punch.

2. The press-molded article manufacturing method of claim 1, wherein a relative positional relationship between the inner pad and the die pad is maintained from the disposing of the die pad at the position until completion of the forming of the top plate.

3. The press-molded article manufacturing method of claim 2, wherein a stopper is provided at one of the inner pad or the die pad such that the stopper projects the predetermined distance toward a side of the other of the inner pad or the die pad.

4. The press-molded article manufacturing method of claim 3, wherein:

a punch-side inclined face is formed at the apex portion of the punch so as to become increasingly indented on progression from a shoulder of the punch toward a width direction central side of the punch;

a die-side inclined face that corresponds to the punch-side inclined face is formed at an opposing face of the die opposing the apex portion of the punch; and in the latter part of the forming of the top plate, the metal sheet blank is held by the punch-side inclined face and the die-side inclined face.

5. The press-molded article manufacturing method of claim 2, wherein:

a punch-side inclined face is formed at the apex portion of the punch so as to become increasingly indented on progression from a shoulder of the punch toward a width direction central side of the punch;

a die-side inclined face that corresponds to the punch-side inclined face is formed at an opposing face of the die opposing the apex portion of the punch; and in the latter part of the forming of the top plate, the metal sheet blank is held by the punch-side inclined face and the die-side inclined face.

6. The press-molded article manufacturing method of claim 1, further comprising:

in a latter part of the forming of the side walls, moving the die pad and the die, which have been integrated, toward the punch side relative to the punch to hold the metal sheet blank by the inner pad and the die pad, wherein in the forming of the top plate, the die and the die pad, and the inner pad, are moved toward the punch side relative to the punch in a state in which the metal sheet blank is held by the inner pad and the die pad.

7. The press-molded article manufacturing method of claim 6, wherein:

a punch-side inclined face is formed at the apex portion of the punch so as to become increasingly indented on progression from a shoulder of the punch toward a width direction central side of the punch;

a die-side inclined face that corresponds to the punch-side inclined face is formed at an opposing face of the die opposing the apex portion of the punch; and in the latter part of the forming of the top plate, the metal sheet blank is held by the punch-side inclined face and the die-side inclined face.

8. The press-molded article manufacturing method of claim 1, wherein:

a stopper is provided at one of the inner pad or the die pad such that the stopper projects the predetermined distance toward a side of the other of the inner pad or the die pad, and the stopper is configured to be relatively movable toward a side of the one of the inner pad or the die pad;

a relative positional relationship between the inner pad and the die pad is maintained, from the disposing of the die pad at the position until a latter part of the forming of the top plate, by the stopper abutting the other of the inner pad or the die pad; and in the latter part of the forming of the top plate, the stopper is moved toward the side of the one of the inner pad or the die pad such that the die pad and the die, which have been integrated, move toward the punch side relative to the inner pad and the metal sheet blank is held by the die pad and the inner pad.

9. The press-molded article manufacturing method of claim 8, wherein:

a punch-side inclined face is formed at the apex portion of the punch so as to become increasingly indented on progression from a shoulder of the punch toward a width direction central side of the punch;

a die-side inclined face that corresponds to the punch-side inclined face is formed at an opposing face of the die opposing the apex portion of the punch; and in the latter part of the forming of the top plate, the metal sheet blank is held by the punch-side inclined face and the die-side inclined face.

10. The press-molded article manufacturing method of claim 1, wherein:

a punch-side inclined face is formed at the apex portion of the punch so as to become increasingly indented on progression from a shoulder of the punch toward a width direction central side of the punch;

a die-side inclined face that corresponds to the punch-side inclined face is formed at an opposing face of the die opposing the apex portion of the punch; and in the latter part of the forming of the top plate, the metal sheet blank is held by the punch-side inclined face and the die-side inclined face.

11. A press apparatus that manufactures a metal sheet blank into a press-molded article including side walls extending away from a pair of ridge line portions positioned at both width direction sides of a top plate, the press apparatus comprising:

a punch that includes an inner pad at an apex portion of the punch;

a die that includes a die pad disposed opposing the inner pad;

a first coupling device that couples the inner pad to the punch so as to enable relative movement in an opposing direction of the die and the punch;

a second coupling device that couples the die pad to the die so as to enable relative movement in the opposing direction of the die and the punch; and a controller that actuates the first coupling device and the second coupling device while the side walls are formed by the die and the punch, and maintains the die pad at a position separated from the inner pad by a predetermined distance that is greater than a plate thickness of the metal sheet blank.

12. A press apparatus, comprising:

a punch that includes an apex portion intersecting a pressing direction, an inner pad housing portion formed at the apex portion, punch shoulders provided at both sides of the apex portion, and punch wall faces extending from the respective punch shoulders;

an inner pad that includes an inner pad apex face intersecting the pressing direction, that is housed in the inner pad housing portion, and that is movable in the pressing direction;

a first coupling device that couples the inner pad and the punch together, and that modifies a spacing in the pressing direction between the inner pad and the punch;

a die that includes a die bottom opposing the apex portion, a die pad housing portion formed at the die bottom, bottom corners provided at both sides of the die bottom so as to correspond to the punch shoulders, and die cavity wall faces extending from each of the bottom corners so as to correspond to the punch wall faces;

a die pad that includes an inner pad-opposing face opposing the inner pad apex face, that is housed in the die pad housing portion, and that is movable in the pressing direction;

a second coupling device that couples the die pad and the die together, and that modifies a spacing in the pressing direction between the die pad and the die; and a stopper that is provided at one of the inner pad apex face or the inner pad-opposing face, and that projects in the pressing direction.

13. A press apparatus, comprising:

a punch that includes an apex portion intersecting a pressing direction, an inner pad housing portion formed at the apex portion, punch shoulders provided at both sides of the apex portion, and punch wall faces extending from the respective punch shoulders;

an inner pad that includes an inner pad apex face intersecting the pressing direction, that is housed in the inner pad housing portion, and that is movable in the pressing direction;

a first coupling device that couples the inner pad and the punch together, and that modifies a spacing in the pressing direction between the inner pad and the punch;

a die that includes a die bottom opposing the apex portion, a die pad housing portion formed at the die bottom, bottom corners provided at both sides of the die bottom so as to correspond to the punch shoulders, and die cavity wall faces extending from each of the bottom corners so as to correspond to the punch wall faces;

a die pad that includes an inner pad-opposing face opposing the inner pad apex face, that is housed in the die pad housing portion, and that is movable in the pressing direction;

a second coupling device that couples the die pad and the die together, and that modifies a spacing in the pressing direction between the die pad and the die;

a moving device that moves the die relatively toward the punch side; and a stopper projecting in the pressing direction that is provided at one of the inner pad apex face or the inner pad-opposing face via an extension-retraction mechanism that extends and retracts in the pressing direction, wherein:

an actuation force of the moving device, a retention force in the pressing direction of the extension-retraction mechanism, a retention force of the first coupling device, and a retention force of the second coupling device have a relationship that is either:

the actuation force of the moving device>the retention force in the pressing direction of the extension-retraction mechanism>the retention force of the first coupling device>the retention force of the second coupling device; or the actuation force of the moving device>the retention force of the first coupling device>the retention force in the pressing direction of the extension-retraction mechanism>the retention force of the second coupling device.

* * * * *